US011011364B2

(12) United States Patent
Rusinov et al.

(10) Patent No.: US 11,011,364 B2
(45) Date of Patent: May 18, 2021

(54) APPARATUS CONFIGURED TO PRODUCE AN IMAGE CHARGE/CURRENT SIGNAL

(71) Applicant: SHIMADZU CORPORATION, Kyoto (JP)

(72) Inventors: Aleksandr Rusinov, Manchester (GB); Li Ding, Manchester (GB)

(73) Assignee: SHIMADZU CORPORATION, Kyoto (JP)

( * ) Notice: Subject to any disclaimer, the term of this patent is extended or adjusted under 35 U.S.C. 154(b) by 0 days.

(21) Appl. No.: 16/913,553

(22) Filed: Jun. 26, 2020

(65) Prior Publication Data

US 2021/0013024 A1 Jan. 14, 2021

(30) Foreign Application Priority Data

Jul. 10, 2019 (GB) ..... 1909912

(51) Int. Cl.
*H01J 49/42* (2006.01)
*H01J 49/00* (2006.01)
(Continued)

(52) U.S. Cl.
CPC ..... *H01J 49/4245* (2013.01); *H01J 49/0009* (2013.01); *H01J 49/027* (2013.01); *H01J 49/406* (2013.01)

(58) Field of Classification Search
CPC ..... H01J 49/0009; H01J 49/027; H01J 49/40; H01J 49/424; H01J 49/4245; H01J 49/426
See application file for complete search history.

(56) References Cited

U.S. PATENT DOCUMENTS 6,888,130 B1 * 5/2005 Gonin ..... H01J 49/027 250/281
8,664,590 B2 * 3/2014 Ding ..... G06T 5/00 250/282
(Continued)

FOREIGN PATENT DOCUMENTS

EP 2 642 508 A2 9/2013
EP 2 779 206 A2 9/2014
(Continued)

OTHER PUBLICATIONS

J. B. Greenwood et al, "A comb-sampling method for enhanced mass analysis in linear electrostatic ion traps", Review of Scientific Instruments, 2011, pp. 43103 to 43103-12, vol. 82.
(Continued)

*Primary Examiner* — David E Smith
(74) *Attorney, Agent, or Firm* — Sughrue Mion, PLLC

(57) ABSTRACT

An apparatus configured to produce an image charge/current signal representative of trapped ions undergoing oscillatory motion. The apparatus includes: an electrostatic ion trap configured to trap ions such that the trapped ions undergo oscillatory motion in the electrostatic ion trap; an image charge/current detector configured to obtain an image charge/current signal representative of trapped ions undergoing oscillatory motion in the electrostatic ion trap, wherein the electrostatic ion trap configured to trap ions such that the image charge/current signal in the time domain repeats, for ions of a given mass/charge ratio m, at a frequency $f_{sig}(m)$ [Hz] with a signal period $T_{sig}(m)$ [s]. The image charge/current detector includes one or more pickup electrodes configured to obtain the image charge/current signal. The one or more pickup electrodes are arranged to detect two signal pulses caused by ions having the given mass/charge ratio m within each signal period $T_{sig}(m)$. The one or more pickup electrodes are further arranged such that
(Continued)

the time separation $\Delta t_{sep}(m)$ between the two signal pulses caused by ions having the given mass/charge ratio m within each signal period $T_{sig}(m)$ is approximately equal to $2p+1/2.n.f_{sig}(m)$ so as to suppress a predetermined nth harmonic within the image charge/current signal, where n is an integer that is 1 or more, and where p is an integer that is 0 or more.

15 Claims, 15 Drawing Sheets

(51) Int. Cl.
*H01J 49/40* (2006.01)
*H01J 49/02* (2006.01)

(56) References Cited

U.S. PATENT DOCUMENTS

| | | | | |
|---|---|---|---|---|
| 8,890,060 | B2 * | 11/2014 | Ding | H01J 49/027 250/282 |
| 2017/0084445 | A1 * | 3/2017 | Ding | H01J 49/067 |
| 2020/0411299 | A1 * | 12/2020 | Baba | H01J 49/0031 |

FOREIGN PATENT DOCUMENTS

| | | | |
|---|---|---|---|
| WO | 2012/116765 | A1 | 9/2012 |
| WO | 2017/162779 | A1 | 9/2017 |
| WO | 2019/058226 | A1 | 3/2019 |

OTHER PUBLICATIONS

United Kingdom search report for GB1909912.6 dated Dec. 13, 2019.

* cited by examiner

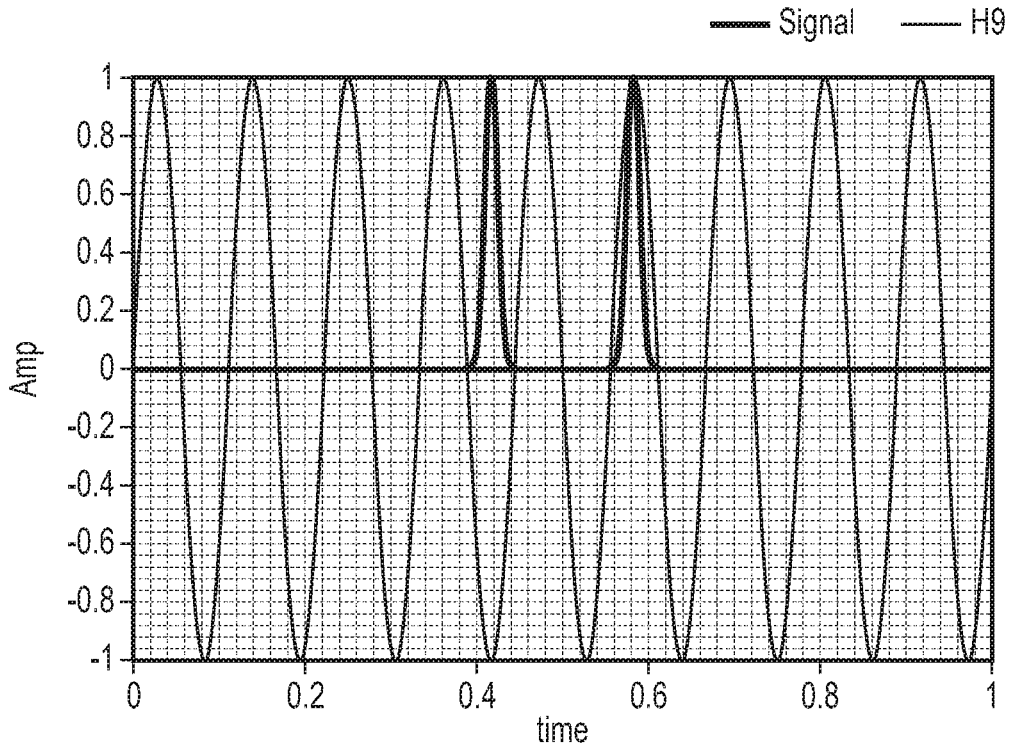
FIG. 10A(ii)
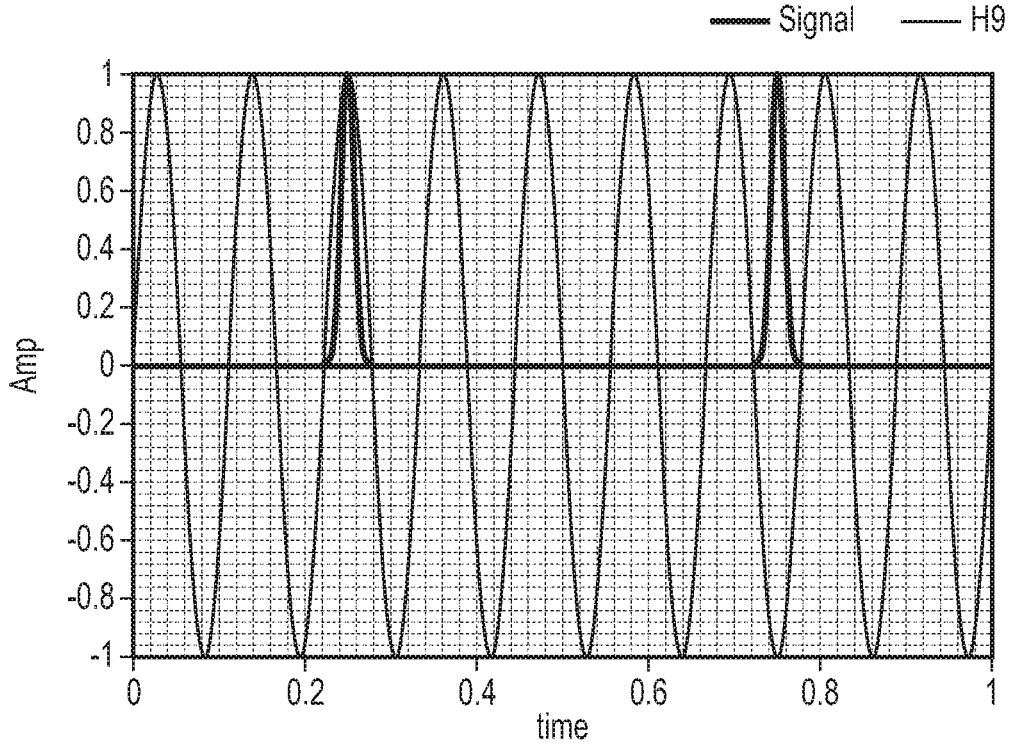
FIG. 10B(ii)

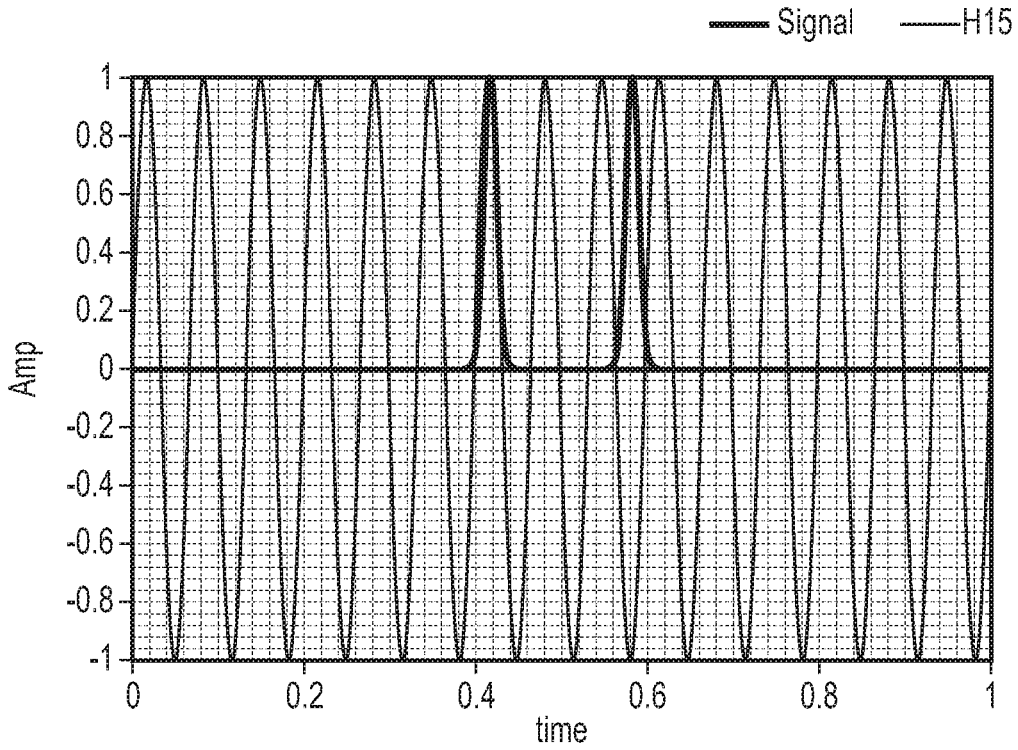
FIG. 10A(iii)
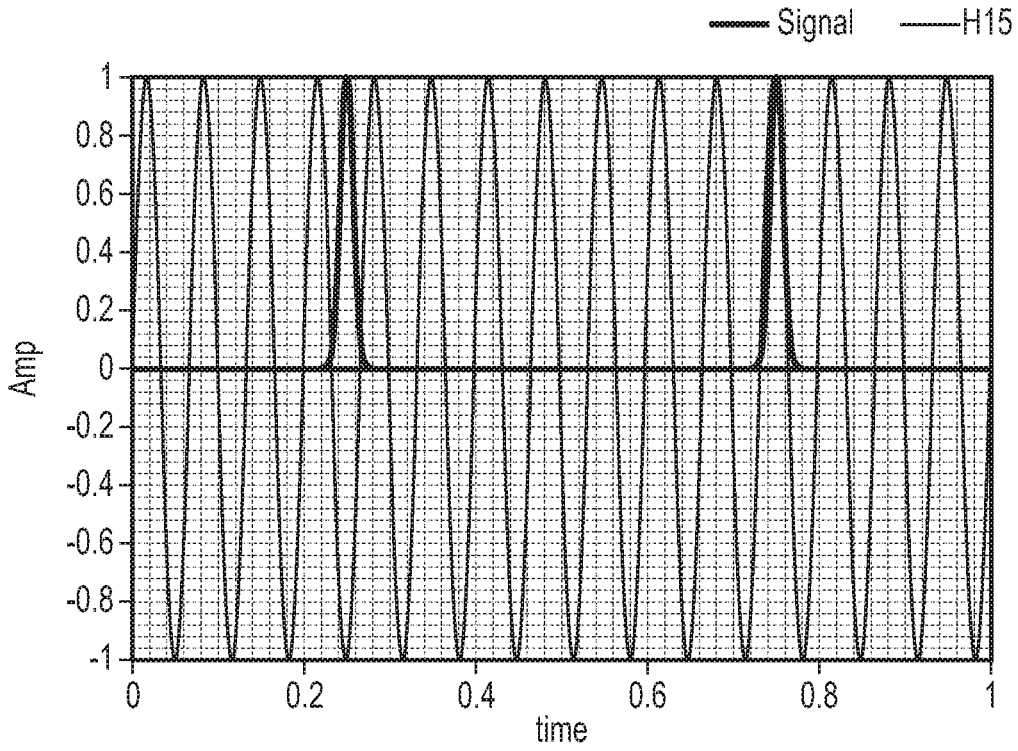
FIG. 10B(iii)

APPARATUS CONFIGURED TO PRODUCE AN IMAGE CHARGE/CURRENT SIGNAL

CROSS-REFERENCE TO RELATED APPLICATIONS

This application claims priority from GB 1909912.6, filed Jul. 10, 2019, the entire contents of which are herein incorporated by reference.

FIELD OF THE INVENTION

The present invention relates to an apparatus configured to produce an image charge/current signal representative of trapped ions undergoing oscillatory motion.

BACKGROUND

Electrostatic ions traps for mass analysis that utilize non-harmonic oscillations of ions are known.

For example, WO2012/116765A1 discloses a variety of forms of electrostatic ion trap that utilize non-harmonic oscillations of ions.

Ions in an electrostatic ion trap can, depending on the configuration of the ion trap, perform harmonic or non-harmonic oscillations. In general terms, harmonic oscillations can be understood as oscillations that produce a signal whose amplitude A changes with time t as $A(t)=A_0 \sin(ft+a)$ wherein f and a correspond to the frequency and phase of oscillations, respectively. Whereas non-harmonic oscillations can be understood as oscillations that produce a signal whose amplitude behavior deviates from a sinusoidal function.

Image charge signal detected in an electrostatic ion trap based on non-harmonic oscillation of ions results in a complex frequency spectrum which consists of multiple harmonics having frequencies which correspond frequencies of ion oscillations. If a relatively wide range of ion masses is being studied, then harmonics corresponded to different ion masses may overlap each other in the frequency spectrum. Therefore, before the frequencies of ion oscillations can be related to the mass to charge ratio of ions, the frequency spectrum typically needs to be deciphered or purified of one or more harmonic orders, e.g. by suppressing unwanted harmonics. For example, after second and fourth harmonics are cleared from the frequency spectrum, one can obtain a frequency spectrum consisting of only third harmonics corresponded to triple frequency of each ion mass which can unambiguously be converted into mass spectrum (provided mass range is not so large that other harmonics do not overlap with the third harmonic). A benefit in looking at higher order harmonics in the frequency spectrum (i.e. $H_n$, where n=2 or more) is that it provides higher mass resolving power (compared with the fundamental frequency $H_1$, aka the first harmonic frequency) without increasing time duration of a measured signal.

Various methods have been proposed to obtain a mass spectrum from a non-harmonic signal.

EP2642508A2 discloses a linear combination method that requires N+1 pick-up electrodes to eliminate N harmonics from a frequency spectrum. The disadvantage is requirement in several electrodes and respective signals measurements (proportional increase in amplifier quantity, data acquisition system and data size). Another disadvantage is the method cannot cope with aliquoted ions' frequencies. Also, after linear combination is performed signal to noise ratio (S/N) may be deteriorated.

EP2779206A2 discloses a method that includes applying a validity test to each of a plurality of peaks in an image charge/current signal in the frequency domain, wherein applying the validity test to a peak in the image charge/current signal in the frequency domain includes determining whether a phase angle associated with the peak meets a predetermined condition. The method also includes forming a new image charge/current signal that: includes data representative of one or more peaks that have passed the validity test; and excludes data representative of one or more peaks that have failed the validity test.

WO2017162779A1 discloses targeted orthogonal projection of signal. It requires substantial post processing work and one or set of calibration signals. The method defines ion frequency candidates for each peak from a frequency spectrum, then generating signals for each candidate using calibration signal(s) and subsequent system of linear equations solvation which outputs intensities for each frequency candidate. The disadvantage is extensive computer resources and time are needed to get mass spectrum.

The present invention has been devised in light of the above considerations.

SUMMARY OF THE INVENTION

In a first aspect, the present invention provides:

An apparatus configured to produce an image charge/current signal representative of trapped ions undergoing oscillatory motion, the apparatus including:

an electrostatic ion trap configured to trap ions such that the trapped ions undergo oscillatory motion in the electrostatic ion trap;

an image charge/current detector configured to obtain an image charge/current signal representative of trapped ions undergoing oscillatory motion in the electrostatic ion trap, wherein the electrostatic ion trap configured to trap ions such that the image charge/current signal in the time domain repeats, for ions of a given mass/charge ratio m, at a frequency $f_{sig}(m)$ [Hz] with a signal period $T_{sig}(m)$ [s];

wherein the image charge/current detector includes one or more pickup electrodes configured to obtain the image charge/current signal;

wherein the one or more pickup electrodes are arranged to detect two signal pulses caused by ions having the given mass/charge ratio m within each signal period $T_{sig}(m)$; and wherein the one or more pickup electrodes are further arranged such that the time separation $\Delta t_{sep}(m)$ between the two signal pulses caused by ions having the given mass/charge ratio m within each signal period $T_{sig}(m)$ is approximately equal to $$\frac{2p+1}{2 \cdot n \cdot f_{sig}(m)}$$

preferably so as to suppress a predetermined nth harmonic within the image charge/current signal, where n is an integer that is 1 or more, and where p is an integer that is 0 or more.

Thus, by carefully arranging the one or more pickup electrodes, the predetermined nth harmonic within the image charge/current signal can be suppressed, without the need for complex computational steps.

This is particularly useful where the ions undergo non-harmonic oscillatory motion (e.g. in a linear ion trap) since, as discussed above, it is for non-harmonic oscillatory motion where second and higher order harmonics can be most problematic.

The given mass/charge ratio m may be recorded in Da per unit of elementary charge ($e=1.60217662\times10^{-19}$ C. Mass/charge ratio may optionally be referred to as m/z rather than m (m is actually being used as shorthand for m/z).

For ions of the given mass/charge ratio m, the nth harmonic $H_n$ will have a frequency of $n.f_{sig}(m)$. For example, the first (fundamental or primary) harmonic $H_1$ will have a frequency $f_1(m)=f_{sig}(m)$, the second harmonic $H_2$ will have a frequency $f_2(m)=2.f_{sig}(m)$ and so on. The above condition $$\Delta t_{sep}(m) = \frac{2p+1}{2\cdot n\cdot f_{sig}(m)}$$

thus equates to $$\Delta t_{sep}(m) = \frac{2p+1}{2f_{Hn}(m)}.$$

Where this condition is met, the nth harmonic is suppressed because respective Fourier coefficient turns into zero due to equal positive and negative parts after integration in the vicinity of each signal pulse, see the "theoretical explanation" below for more details.

Here it is worth adding that the nth harmonic is not the only harmonic that is suppressed when the $$\Delta t_{sep}(m) = \frac{2p+1}{2\cdot n\cdot f_{sig}(m)}$$

condition set out above is met. Rather if the $$\Delta t_{sep}(m) = \frac{2p+1}{2\cdot n\cdot f_{sig}(m)}$$

condition set out above is met, then each of the harmonics $H_{(2k+1)n}$ will be suppressed, where k=0, 1, 2, 3, . . . , because respective Fourier coefficients turns into zero due to equal positive and negative parts after integration in the vicinity of each signal pulse, again see the "theoretical explanation" below for more details.

Thus, for example, if n=2, then each of the harmonics $H_2$, $H_6$, $H_{10}$, . . . , will be suppressed (but not $H_3$, $H_4$, $H_5$, $H_7$ etc.

Similarly, if n=3, then each of the harmonics $H_3$, $H_9$, $H_{15}$, . . . will be suppressed (but not $H_2$, $H_4$, $H_5$, $H_6$ etc.

In some embodiments, n is chosen to be an integer that is 2 or higher.

In other embodiments, n=1. Here we note that suppression of H1, H3,H5, H7 (all odd harmonics) can be achieved by setting n=1, effectively doubling frequency of the peaks in the frequency domain. In an electrostatic ion trap with circular field forming electrodes (see below), this could be achieved using a pickup electrode having a particular diameter, or using a reflection electrode at high voltage and central electrode as pick-up electrodes (though this latter option could be more complex to implement).

Note that although the $$\Delta t_{sep}(m) = \frac{2p+1}{2\cdot n\cdot f_{sig}(m)}$$

condition set out above is defined in relation to ions having a given mass/charge ratio, if this condition is satisfied for ions having the given mass/charge ratio, it will apply to ions having all other mass/charge ratios because ion motion takes place in a static electrical field, i.e. trajectory of ions with mass/charge ratio of $m_1$ can be converted into trajectory of another mass/charge ratio of $m_2$ by scaling time axis as $$t \rightarrow t\sqrt{\frac{m_2}{m_1}}.$$

This means that it ions with mass/charge of m having oscillation period of T induce spikes separated by dT in time domain signal then ratio T/dT will always be the same regardless of m value. Because of this independence electrodes located at $1/2nf_{sig}$ will give suppression at the same set of harmonics for any mass/charge ratio.

Herein, "approximately equal" may be taken to mean the same as ±5%, more preferably the same as ±1%, more preferably the same as ±0.1%.

Preferably, n=2, such that the $2^{nd}$ harmonic within the image charge/current signal is suppressed.

If n=2, then preferably the apparatus is configured to be used with ions having a mass/charge ratio range ($m_{min}$ to $m_{max}$) such that the H1 peaks in the frequency spectrum for ions in the mass/charge ratio range do not overlap with the H3 peaks in the frequency spectrum for ions in the mass/charge ratio range. In this way, confusion between H1 peaks and H3 peaks in the frequency spectrum can be avoided. If n=2, then preferably the apparatus is configured to be used with ions having a mass/charge ratio range ($m_{min}$ to $m_{max}$) such that the H1 peaks in the frequency spectrum for ions in the mass/charge ratio range do not overlap with the H3 peaks in the frequency spectrum for ions in mass/charge ratio range but do overlap with the (suppressed) H2 peaks in the frequency spectrum for ions in the mass/charge ratio range. In this way, confusion between H1 peaks and H3 peaks can be avoided, whilst making use of the additional separation in the frequency spectrum resulting from suppressing the H2 peaks.

In other examples, n=3, such that the $3^{rd}$ harmonic within the image charge/current signal is suppressed.

If n=3, then preferably the apparatus is configured to be used with ions having a mass/charge ratio range ($m_{min}$ to $m_{max}$) such that the H2 peaks in the frequency spectrum for ions in the mass/charge ratio range do not overlap with the H4 peaks in the frequency spectrum for ions in the mass/charge ratio range. In this way, confusion between H2 peaks and H4 peaks in the frequency spectrum can be avoided, which may help in allowing the H2 or H4 peaks to be studied.

As noted above, a benefit in looking at higher order harmonics in the frequency spectrum (i.e. $H_n$, where n=2 or more) is that it provides higher mass resolving power (compared with the fundamental frequency $H_1$, aka the first harmonic frequency) without increasing time duration of a measured signal.

Preferably, n is less than 10, more preferably n is less than 5. That is, preferably the predetermined harmonic being suppressed is a relatively low order harmonic.

The two signal pulses may appear as two simple peaks in the time domain signal, or have more complex forms, e.g. with each signal pulse including more than one individual peak.

In general, the one or more pickup electrodes are preferably arranged such that the two signal pulses within each signal period $T_{sig}(m)$ are substantially the mirror image of each other in the time domain, e.g. as illustrated below with reference to FIGS. 11A-C. This helps to maximize suppression of the predetermined nth harmonic within the image charge/current signal.

To achieve this, the pick-up electrode(s) is (are) preferably chosen to be symmetric with respect to the trap geometry (e.g. axis or plane symmetry of the trap coincides with that of pick-up electrode), in order to maximize suppression of the predetermined nth harmonic. This is discussed in more detail below, e.g. with reference to FIGS. 11A-C.

The time separation $\Delta t_{sep}(m)$ may be measured with respect to corresponding features in the two signal pulses caused by ions having the given mass/charge ratio m within each signal period $T_{sig}(m)$. The corresponding features may be a maxima of each of the two signal pulses, or a weighted centre of each of the two signal pulses.

As would be appreciated by a skilled person, the apparatus configured to produce an image charge/current signal representative of trapped ions undergoing oscillatory motion could take a variety of forms.

Preferably, the apparatus configured to produce an image charge/current signal representative of trapped ions undergoing oscillatory motion is an electrostatic ion trap. The electrostatic ion trap may have field forming electrodes configured to generate an electrostatic field in which the oscillatory motion takes place.

Preferably, the/each pickup electrode is embedded within a (respective) field forming electrode of the electrostatic ion trap, e.g. the/each pickup electrode may be embedded at least partly (preferably entirely) within a cavity of a respective field forming electrode.

The/each pickup electrode embedded within a (respective) field forming electrode of the electrostatic ion trap may be configured to be moveable within the (respective) field forming electrode in which it is embedded, preferably with the cavity in the (respective) field forming electrode being large enough to accommodate movement of the pick-up electrode. In this way, the location of the/each embedded pickup electrode can be changed as needed without unnecessarily impacting on the electrostatic field, e.g. which may be useful in ensuring that the one or more pickup electrodes are arranged such that above condition $$\Delta t_{sep}(m) = \frac{2p+1}{2 \cdot n \cdot f_{sig}(m)}$$

is met for those pickup electrodes.

Moveable electrodes would be most feasible for linear oscillations, but would be more challenging for other geometries where there is drift of ions perpendicular to ion motion (e.g. cylindrical geometries).

The electrostatic ion trap is preferably configured to produce an image charge/current signal representative of trapped ions undergoing non-harmonic oscillatory motion.

A skilled person would recognize that a variety of forms of electrostatic ion trap are capable of producing an image charge/current signal representative of trapped ions undergoing non-harmonic oscillatory motion.

For example, the electrostatic ion trap may be a linear electrostatic ion trap. The linear ion trap may have field forming electrodes configured to generate an electrostatic field in which linear oscillatory motion takes place. The linear ion trap may be configured to produce an image charge/current signal representative of trapped ions undergoing linear oscillatory motion predetermined location about which the ions oscillate, whereby ions move backwards and forwards in a direction of ion motion (e.g. about a reference axis, which reference axis may be determined by the electrostatic field).

As another example, the electrostatic ion trap may have a form as described in WO2012/116765A1.

In a particularly preferred example (referred to herein for brevity as a "electrostatic ion trap with circular field forming electrodes"), the apparatus is an electrostatic ion trap having a first set of concentrically arranged circular field forming (e.g. circular plate) electrodes centered on a reference axis and arranged on a first side of a mid-plane, and a second set of concentrically arranged field forming (e.g. circular plate) electrodes centered on the reference axis and arranged on a second (opposite) side of the mid-plane, wherein the field forming electrodes (in the first and second sets) are configured to generate an electrostatic field in which ions undergo linear oscillatory motion in the mid-plane (e.g. about a predetermined central location), whilst precessing around the reference axis. Such a device is disclosed herein, and also in WO2012/116765A1 (see e.g. FIG. 10A), for example.

In an electrostatic ion trap with circular field forming electrodes, the one or more pickup electrodes may include a first circular pickup electrode that is centered on the reference axis. The first circular pickup electrode may be positioned on the first side of the mid plane, among the first set of field forming electrodes. The first pickup electrode may be embedded within one of the first set of field forming electrodes. The first circular pickup electrode may be arranged such that the time separation $t_{sep}(m)$ between the two signal pulses caused by ions having the given mass/charge ratio m within each signal period $T_{sig}(m)$ is approximately equal to $$\frac{1}{2 \cdot n \cdot f_{sig}(m)}$$

by appropriately configuring a radius (e.g. an innermost radius) of the first circular pickup electrode.

The first circular pickup electrode may be the only pickup electrode.

However, preferably, the one or more pickup electrodes also include a second pickup electrode that is centered on the reference axis. The second pickup electrode may be positioned on the second side of the mid plane, among the second set of field forming electrodes. The second pickup electrode may be embedded within one of the second set of field forming electrodes. The second pickup electrode preferably has a shape and size that matches that of the first pickup electrode. The second circular pickup electrode may be arranged such that the time separation $t_{sep}(m)$ between the two signal pulses caused by ions having the given mass/charge ratio m within each signal period $T_{sig}(m)$ is approximately equal to $$\frac{1}{2 \cdot n \cdot f_{sig}(m)}$$

by appropriately configuring a radius (e.g. an innermost radius) of the second circular pickup electrode. The radius of the second circular pickup electrode may thus be the same as the radius of the first circular pickup electrode.

Whilst an electrostatic ion trap with circular field forming electrodes is a preferred geometry for the present invention, other geometries are possible. For example, the apparatus may be an electrostatic ion trap which utilizes sector fields, as disclosed for example in US9082602 or an Orbitrap or a Fourier transform ion cyclotron resonance device. An orbitrap or Fourier transform ion cyclotron resonance device is not preferred, as these are generally used in trapping ions to perform harmonic oscillatory motion.

Further suppression of harmonics in the image charge/current signal could be achieved by configuring the apparatus to additionally apply any one or more of the methods of EP2642508, EP2779206A2 or WO2012/116765A1.

For example, the apparatus could be configured to produce a plurality of image charge/current signals representative of ions undergoing oscillatory motion, wherein the apparatus is configured to:

produce a linear combination of the plurality of image charge/current signals using a plurality of predetermined coefficients, the predetermined coefficients having been selected so as to suppress at least one xth harmonic component of the image charge/current signals within the linear combination of the plurality of image charge/current signals.

Here, x may be an integer that is 1 or more. Here x may be the same as n (i.e. the linear combination of image charge/current signals may suppress the harmonic suppressed by the arrangement of the one or more pickup electrodes, e.g. as might be useful if the one or more pickup electrodes are imprecisely positioned and therefore do not achieve optimum suppression).

It is also possible that x might be different from n (i.e. the linear combination of image charge/current signals might suppress a harmonic other than the harmonic suppressed by the arrangement of the one or more pickup electrodes, e.g. as might be useful for suppressing additional harmonics).

Techniques for suppressing a predetermined harmonic using a linear combination of image charge/current signals are taught by EP2642508, the content and techniques of which are incorporated herein by reference.

The first aspect of the present invention may provide a mass spectrometer that includes:

an apparatus as set out above; and a processing apparatus configured to process the image charge/current signal obtained by the image charge/current detector.

The processing apparatus is preferably configured to convert the image charge/current signal from the time domain into the frequency domain (e.g. using a fourier transform), to obtain a frequency spectrum. In this case, the mass spectrometer may be a Fourier Transform mass spectrometer.

As is known in the art, a frequency spectrum obtained in this way can effectively be viewed as a mass spectrum. However, for reasons discussed e.g. in EP2642508, it is preferably to avoid overlapping harmonics within such a spectrum, to avoid false peaks.

According to a second aspect of the invention, there is provided a method of tuning an apparatus according to the first aspect of the invention.

The method may include:

increasing the suppression of the predetermined nth harmonic relative to the fundamental (H1) harmonic in a frequency spectrum obtained from the image/charge current signal for ions of a given mass/charge ratio m by changing the position of the/each pick-up electrode.

The/each pick-up electrode whose position is changed may be embedded within a field forming electrode as described above.

The method may include:

increasing the suppression of the predetermined nth harmonic relative to the fundamental (H1) harmonic in a frequency spectrum obtained from the image/charge current signal for ions of a given mass/charge ratio m by changing the shape of the/each pick-up electrode.

According to a third aspect of the invention, there is provided a method of operating an apparatus according to the first aspect of the invention.

The method may include any method step implementing or corresponding to any apparatus feature described in connection with any above aspect of the invention.

The invention includes the combination of the aspects and preferred features described except where such a combination is clearly impermissible or expressly avoided.

SUMMARY OF THE FIGURES

Embodiments and experiments illustrating the principles of the invention will now be discussed with reference to the accompanying figures in which.

DETAILED DESCRIPTION OF THE INVENTION

Figure 1:
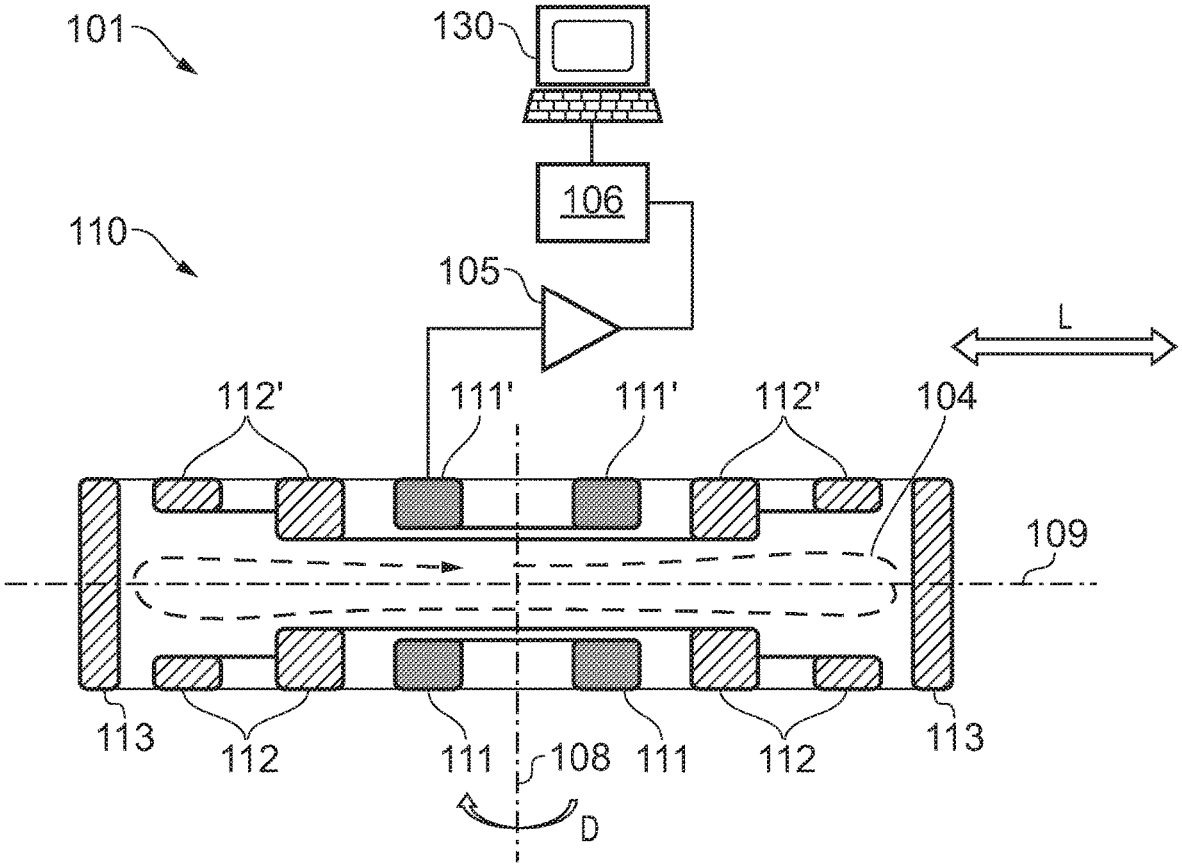
FIG. 1 shows an example Fourier Transform mass spectrometer.

Aspects and embodiments of the present invention will now be discussed with reference to the accompanying figures. Further aspects and embodiments will be apparent to those skilled in the art. All documents mentioned in this text are incorporated herein by reference.

In general terms, the following discussion sets out a method to eliminate harmonics in frequency spectra of image charge/current signals representative of trapped ions undergoing oscillatory motion, particularly non-harmonic oscillatory motion. The method allows certain harmonics to be suppressed or even eliminated in the frequency spectra of such signals by means of positioning one or more pick-up electrodes at one or more specific locations. It there thereby possible to substantially suppress certain harmonics in frequency spectra of such signals without additional post processing, compared to signals obtained from other pick-up electrodes located elsewhere. This allows elimination of certain high order harmonics of non-harmonic signals without additional signal processing.

The described methods may be used to get simplified frequency spectra of non-harmonic periodic signals generating more than one harmonic component, for example pick-up electrode in Fourier Transform mass spectrometry (FTMS) instruments which use image charge detection.

Unlike previously described methods, such as those disclosed e.g. in EP2642508A2, EP2779206A2, WO2017162779A1, the described methods don't require additional post-processing, and certain harmonics can be eliminated for any set of masses (including aliquoted), without necessarily involving deterioration in S/N ratio.

In more detail, the present inventors have found that arranging one or more pick-up electrodes according to the present invention is able to suppress a predetermined nth harmonic $H_n$ (where n is an integer that is 2 or higher) within the image charge/current signal, and more generally results in suppression of harmonics $H_{(2k+1)n}$, where k=0, 1, 2, 3, . . .

For example, if n=2, then each of the harmonics $H_2$, $H_6$, $H_{10}$, . . . will be suppressed (but not $H_3$, $H_4$, $H_5$, $H_7$ etc.

For example, if n=3, then each of the harmonics $H_3$, $H_9$, $H_{15}$, . . . will be suppressed (but not $H_2$, $H_4$, $H_5$, $H_6$ etc.

In an example in which one or more pick-up electrodes are arranged according to the present invention where n=3, then the third harmonic $H_3$ can be substantially suppressed, for instance by more than 100 times compared with other non-suppressed harmonic, e.g. H1. This would allow the second harmonic $H_2$ frequency spectrum to be converted into a mass spectrum, even if the mass range is so large that the third harmonic $H_3$ frequency range overlaps second harmonic $H_2$ frequency range. Thus, a mass spectrometer configured to make use of the second harmonic $H_2$ frequency range would be able to have an expanded mass range without running into problems caused by the second harmonic $H_2$ frequency range overlapping with the third harmonic $H_3$ frequency range. Note, however, that unless the fourth harmonic $H_4$ frequency range was suppressed by some other methodology (e.g that taught by EP2642508A2), the mass range ought to be chosen here such that the fourth harmonic $H_4$ frequency range does not overlap the second harmonic $H_2$ frequency range. These requirements can be satisfied by appropriately configuring the mass spectrometer settings.

In an example in which one or more pick-up electrodes are arranged according to the present invention where n=2, which allows the first (fundamental) harmonic $H_1$ frequency spectrum to be converted into a mass spectrum, even if the mass range is so large that the second harmonic $H_2$ frequency range overlaps the first harmonic $H_1$ frequency range. Note, however, that unless the third harmonic $H_3$ frequency range was suppressed by some other methodology (e.g that taught by EP2642508A2), the mass range ought to be chosen here such that the third harmonic $H_3$ frequency range does not overlap the first harmonic $H_1$ frequency range. These requirements can be satisfied by appropriately configuring the mass spectrometer settings.

In general terms, the pick-up electrode(s) is (are) preferably chosen to be symmetric with respect to the trap geometry (e.g. axis or plane symmetry of the trap coincides with that of pick-up electrode), in order to maximize suppression of the predetermined nth harmonic.

Various symmetry arrangements are discussed below in which:

For a planar geometry: the symmetry plane or reference plane is located at the middle of the line connecting opposite ion mirror (reflection) points, i.e. points where ions stop and reflect. Pick-up electrodes arrangement generating one set of mentioned symmetrical peaks on time-domain signal should be symmetrical with respect to the axis(plane) to the other set of electrodes responsible for another set of peaks on time-domain signal, both peaks are within one period of a signal.

For a cylindrical geometry: the symmetry axis or reference axis is located at the axial symmetry of the trap. Axis of circular pick-up electrode(s) generating both set of mentioned symmetrical peaks on time-domain signal should coincide with the axis of a trap.

In some embodiments, the shape of the pick-up electrode may be arbitrary, provided it is positioned correctly.

The required position of electrode to achieve suppression can be determined as follows. If one wanted to suppress the second harmonic $H_2$ (n=2), then for ions of a given mass/charge ratio m, the time distance separation $t_{sep}(m)$ between adjacent peaks in time domain signal of a test ion having a signal period $T_{sig}(m)$ is preferably equal to $$\frac{1}{2f_2} = \frac{1}{4 \cdot n \cdot f_{sig}(m)},$$

where $f_2$ is the frequency of the second harmonic $H_2$ of the ion, and $f_{sig}(m)$ is the frequency at which the image charge/current signal repeats in the time domain for ions of the given mass/charge ratio m (note that $f_2=2f_{sig}(m)$).

In the case that the pick-up electrode is a ring-shaped electrode as discussed below with reference to FIG. 1, this means the ring must have a specific radius chosen to meet the condition $t_{sep}(m)$ is approximately equal to $$\frac{1}{4 \cdot f_{sig}(m)}.$$

This will result in suppression of $H_2$, $H_6$, $H_{10}$, . . . in the frequency spectrum for each ion's mass contributing to the signal.

Note that the time separation for ions of a given mass/charge ratio m can be determined through simulations of ion movement in electrostatic field with required geometry and potentials so as to get suitable focusing properties. This could alternatively be determined experimentally, e.g. by moving the pick-up electrode(s) until the required time separation is achieved.

If one wants to remove $H_3$, then the requirement for the time distance is $$\frac{1}{2f_3} = \frac{1}{6 \cdot f_{sig}(m)},$$

which will result in suppression of $H_3$, $H_9$, $H_{15}$, . . . in the frequency spectrum.

FIG. 1 shows an example Fourier Transform mass spectrometer 101 that includes:

a electrostatic ion trap 110; and a processing apparatus configured to process the image charge/current signal obtained by the image charge/current detector.

In this case, the processing apparatus is a computer 130.

The electrostatic ion trap 110 is an electrostatic ion trap having a first set of concentrically arranged circular field forming plate electrodes 111-113 centered on a reference axis 108 and arranged on a first side of a mid-plane 109, and a second set of concentrically arranged circular field forming plate electrodes 111'-113' centered on the reference axis 108 and arranged on a second (opposite) side of the mid-plane 109, wherein the field forming electrodes 111-113, 111'-113' are configured to generate an electrostatic field in which ions undergo linear oscillatory motion in the mid-plane 109 (e.g. about a predetermined central location where the axis 108 meets the mid-plane 109), whilst precessing around the reference axis 108.

This ion trap 110 implements the principles described in WO2012/116765A1.

In this example, electrodes 111, 111' are the pick-up electrodes at ground or low potential. These pick-up electrodes are configured to produce an image charge/current signal representative of trapped ions undergoing linear oscillatory motion about the reference axis 108, which is generated by ions passing the pick-up electrodes 111, 111'. As described in more detail below, these pick-up electrodes 111,111' are arranged/located to eliminate H2, H6, H10 and so on.

In this example, electrodes 112, 112' are electrodes at high potentials configured to create a trapping and focusing electrostatic field.

Sets of electrodes 111, 112 and 111',112' have the same shape and corresponding positions to each other and are located symmetrically with respect to the mid-plane 109.

In this example, electrodes 113, 113' are reflection electrodes configured to reflect oscillating ions.

The electrodes 111-113, 111'-113' here are in the form of ring-shaped plates, but could be cylindrical in an extreme case.

In the ion trap 110 the pick-up electrodes are arranged to suppress the harmonics H2, H6, H10, etc in a frequency spectrum.

One of the possible ion trajectories is shown by line 104. The image charge signal produced by the pick-up electrodes 111, 111' (which are electrically connected to each other) is amplified by the amplifier 105 and is send to the acquisition system 106 which transfer measured data into computer 130 for recording, visualizing and further processing.

Although two electrodes 111, 111' are used as pick-up electrodes in this case, it would be possible for just one of the electrodes 111, 111' to be used as a pickup electrode 111, though this would mean a weaker signal.

Figure 2:
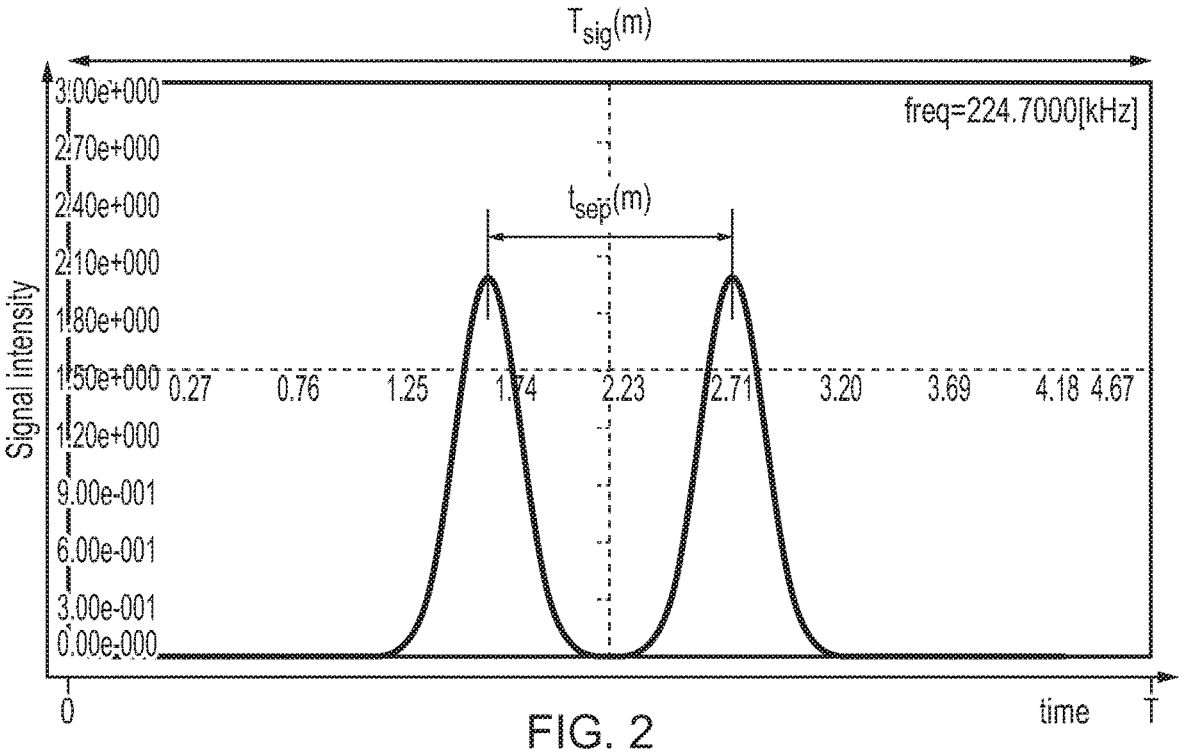
FIG. 2 shows an example simulated time domain signal during one period of oscillation caused by ions having a test mass/charge ratio m.

FIG. 2 shows an example simulated time domain signal during one period of oscillation caused by ions having a test mass/charge ratio m.

What is shown here is one signal period $T_{sig}(m)$ but it is to be noted that this period actually corresponds to half a period of ion oscillation, since this signal will repeat itself twice within one oscillation (note that ions will pass each ring electrode 111, 111' twice on going from one side of the apparatus to the other, and then twice again on the way back). The signal consists of two peaks which repeatedly occur in the image charge signal with the period of $1/f_{sig}(m)$.

In this example, the pick-up electrodes 111, 111' are located such that the time separation $t_{sep}(m)$ between the two signal pulses caused by ions having the test mass/charge ratio m within each signal period $T_{sig}(m)$ is approximately equal to $$\frac{1}{2f_{H_2}(m)} = \frac{1}{4 \cdot f_{sig}(m)}$$

so as to suppress the second harmonic within the image charge/current signal.

In this example, the signal shown in FIG. 2 is generated with the sampling rate of 50 ns, with the duration of 400 ms, and the period of the signal is $T_{sig}(m)$=4.45 us (f=224.7 kHz). This test signal was generated irrelevant of mass, as for any given mass/charge ratio we can adjust the electrical field so that the signal will have the desired frequency of oscillation. It could, for example, be a test mass of 200 Th.

Figure 3:
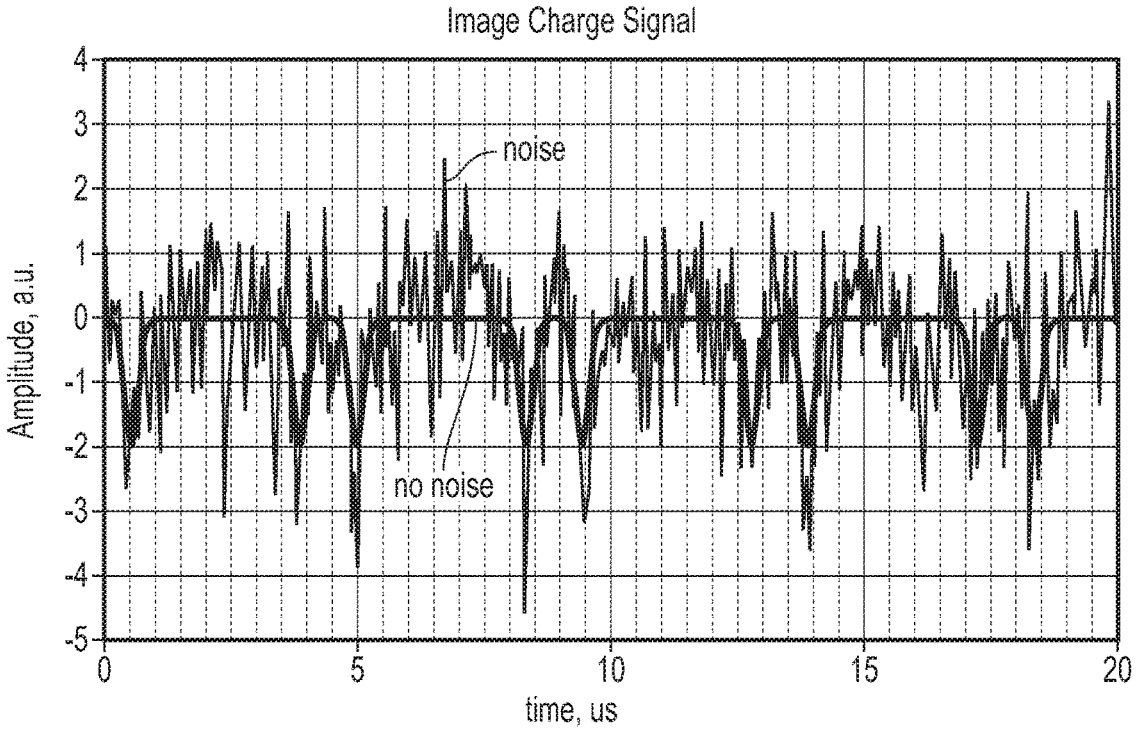
FIG. 3 shows the first 20 us of image charge signal of FIG. 2, both with noise added and with no noise added.

FIG. 3 shows the first 20 us of image charge signal of FIG. 2, both with noise added (simulated normally distributed noise with a standard deviation of 2) and with no noise added.

Figure 4:
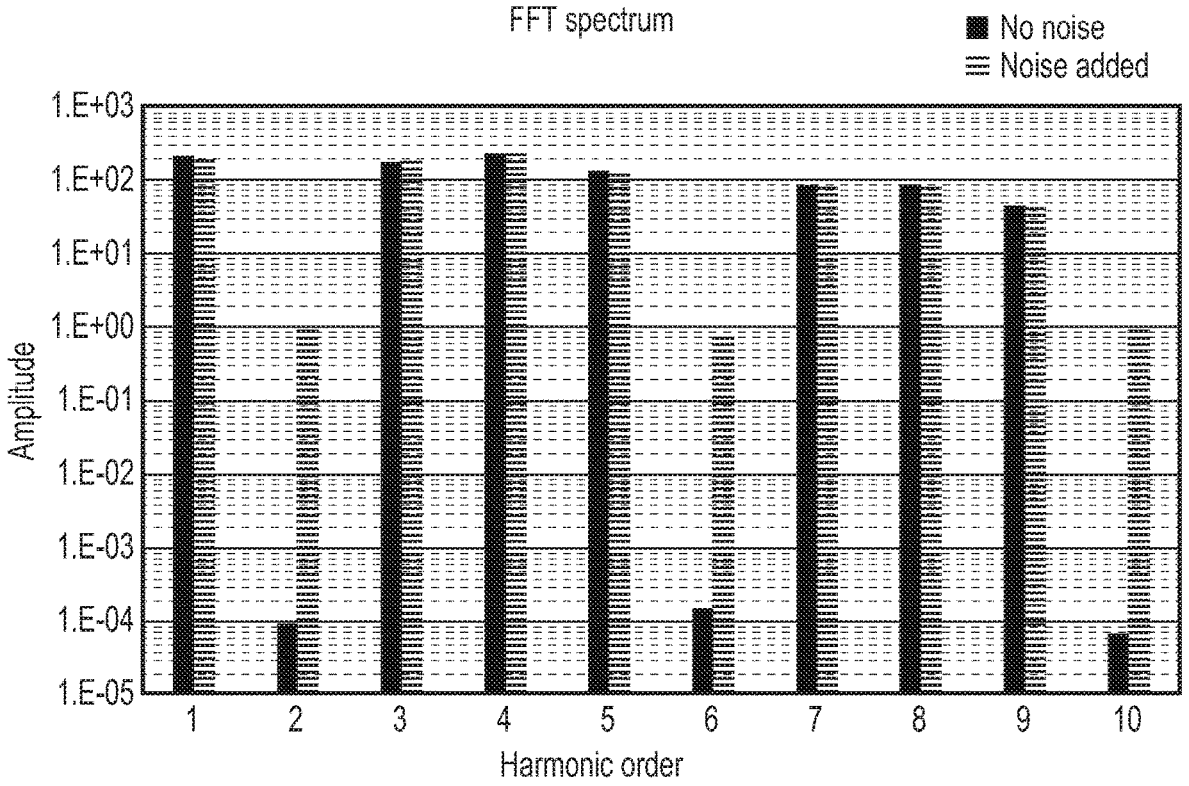
FIG. 4 shows the frequency spectrum (magnitude only) obtained by transforming the simulated test signal of FIG. 2 by means of a Fast Fourier Transform (FFT) algorithm.

FIG. 4 shows the frequency spectrum (magnitude only) obtained by transforming the simulated test signal of FIG. 2 by means of a Fast Fourier Transform (FFT) algorithm.

Note that FIG. 4 shows the result just for the test mass/charge ratio m.

In this example, only $H_1$-$H_{10}$ are shown, although, in general, harmonics continue until $H_n<f_{max}$, with $f_{max}$ to be the maximum measured frequency determined by the sampling rate. It is seen from the figure that $H_2$ amplitude is more than 1 million times smaller than the amplitude of $H_1$, and a similar statement is for $H_6$ and $H_{10}$. The signal with noise results in noise level amplitudes at the location of $H_2$, $H_6$ and $H_{10}$ which, in effect, means complete removal of these harmonics from the frequency spectrum (noting that FIG. 4 has a logarithmic scale).

Figure 5:
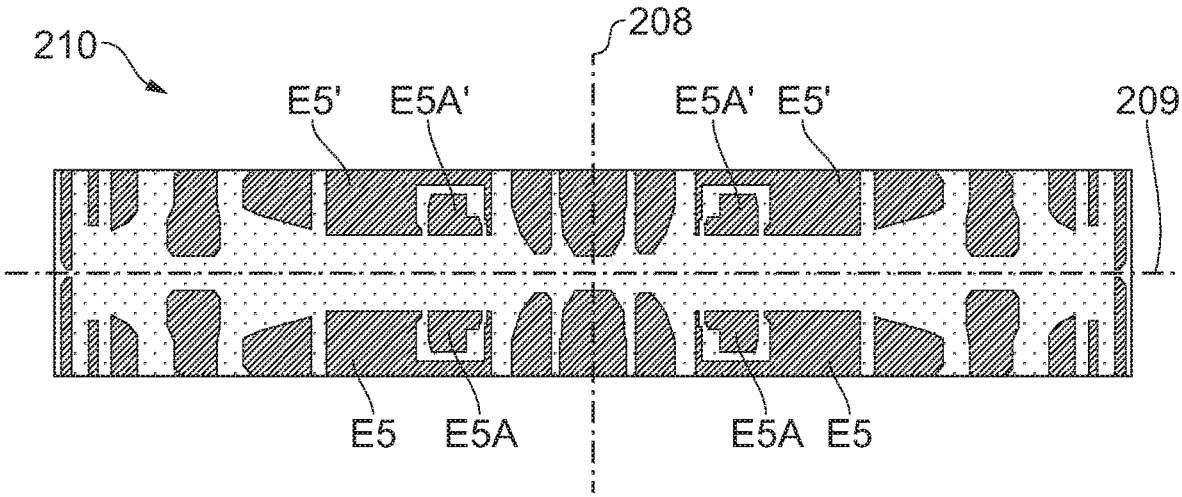
FIG. 5 illustrates a simulated linear electrostatic ion trap 210 implementing the same principles as the electrostatic ion trap 110 of FIG. 1.

Note that suppression of H2 for the test mass m will also lead to suppression of H2 for other masses because due to the reasons noted below, FIG. 5 illustrates a simulated linear electrostatic ion trap 210 implementing the same principles as the electrostatic ion trap 110 of FIG. 1.

In the example of FIG. 5, the electrodes E5A, E5A' were used as the pick-up electrodes.

Note that each pick-up electrode E5A, E5A' is embedded within a respective field forming electrode E5, E5', by being located in a cavity included in that field forming electrode E5, E5'.

Here, the position of E electrode was adjusted to have maximal H2 suppression ratio with respect to H1 (i.e. maximum H1/H2).

Figure 6:
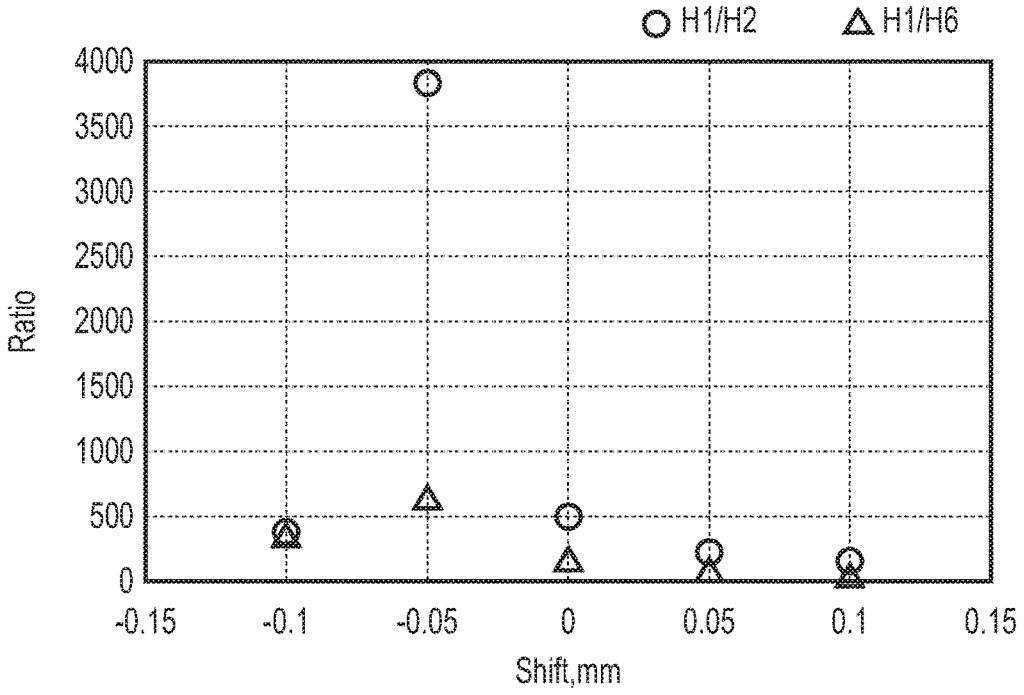
FIG. 6 shows the H2 and H6 suppression ratio depending on the position shift of the pickup electrodes E5A, E5A' in the direction of the mid-plane.

FIG. 6 shows the H2 and H6 suppression ratio depending on the shift in the middle radius of the pickup electrodes E5A, E5A' (middle radius=(R1+R2)/2, where R1 is the inner radius of the ring electrodes and R2 is the outer radius of the ring electrodes) in the radial direction.

As shown in FIG. 6, the H2 and H6 suppression ratio strongly depends on the position accuracy. For example, even a slightly inaccurate position of the pick-up electrodes E5A, E5A' can results in only 100 times suppression, say at H2, and this may not be sufficient as H2 peak with amplitude well above noise level can be wrongly treated as another mass with small intensity.

A position accuracy of perhaps ~50 um may be needed to obtain enough suppression to avoid confusion between different harmonics.

Such high precision may be difficult and expensive to implement, unless the position of the pick-up electrodes E5A, E5A' can be moved within the field forming electrodes E5, E5', as is the case here.

If the pick-up electrodes are not accurately set to achieve suppression, then suppression of unwanted harmonics can be overcome by any one or more of the methods of EP2642508, EP2779206A2 or WO2012/116765A1, e.g. linear combination with another pick-up signal as taught by EP2642508. Linear combination allows to exclude any desired harmonic, e.g. H2, without deterioration of the signal to noise ratio S/N, provided that desired harmonic in the frequency spectrum of another pick-up electrode is not suppressed.

Suppression ratio of different harmonics is the same for an ideal symmetric shape time domain spikes, as presented in FIG. 2. But in practice, real electrode shapes may produce non-symmetric peaks which will result in different suppression ratio.

Figure 7:
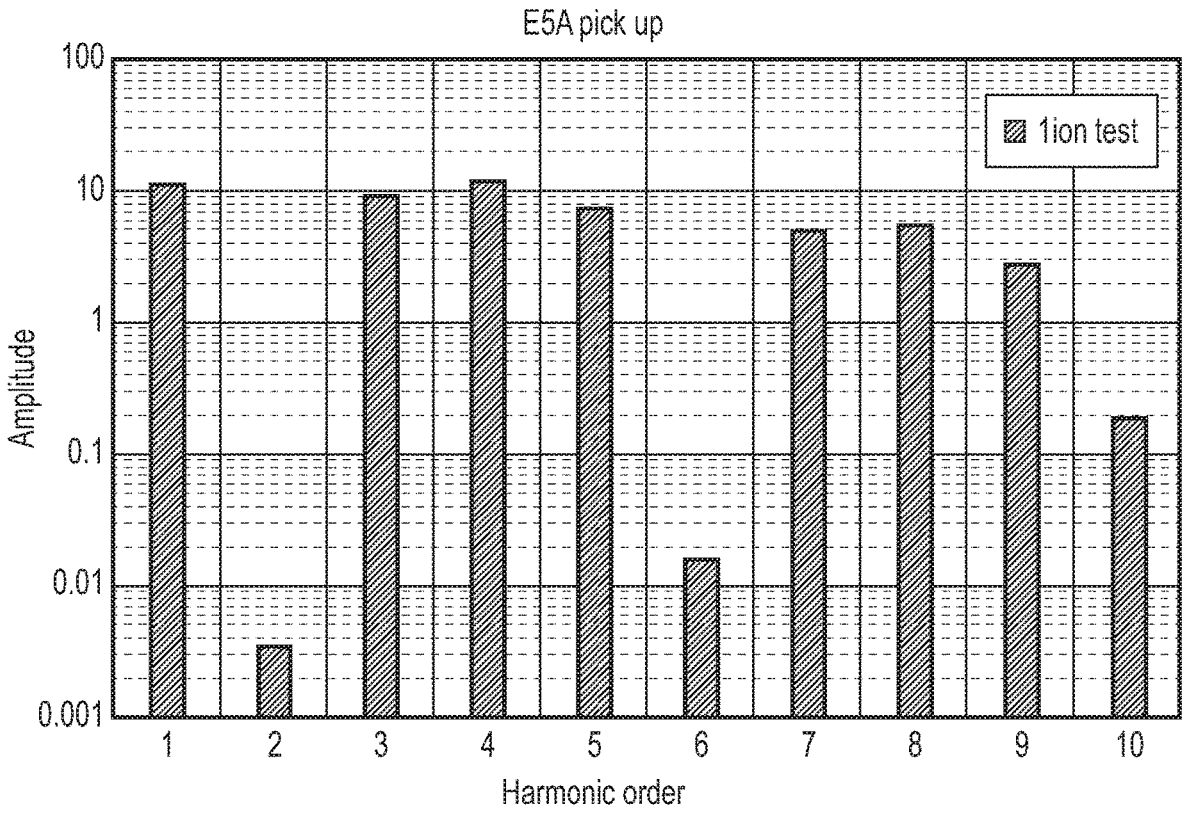
FIG. 7 shows an example frequency spectrum obtained using a test ion with the E5A electrode shown in FIG. 5.

FIG. 7 shows an example frequency (FT) spectrum obtained using a test ion using the E5A electrode shown in FIG. 5, where it is seen that H2 has least intensity of suppressed harmonics, H6 is suppressed but is larger than H2, and H10 is suppressed but is larger than H6. In other words, the suppression of H6 is not as effective as the suppression on H2, and the suppression of H10 is not as effective as the suppression of H6. Further suppression of H6 and H10 (e.g. as quantified by the ratios H6/H1 and H10/H1) can be achieved by fine tuning of the electrode shape, for example. Therefore, two adjustments of the suppression ratio are possible: by means of shift of whole pick-up electrode in order to get maximum suppression of H2 (i.e. lowest H2/H1 ratio), and by means of changes in the shape/geometry of the part of the electrode in order to tune ratio of other high harmonics to be suppressed.

Figure 8:
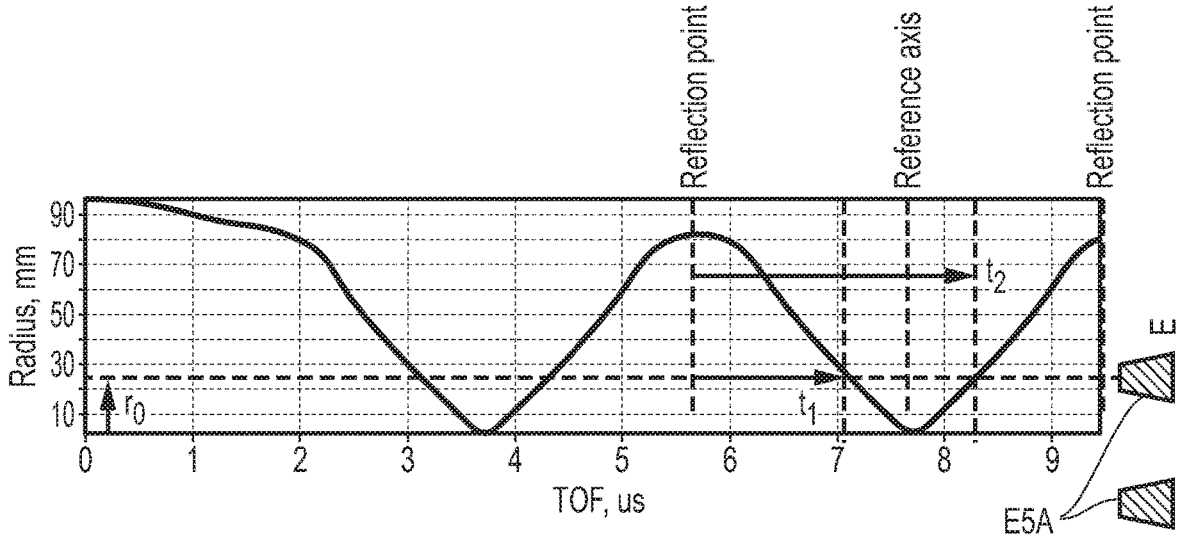
FIG. 8 illustrates another method for determining the location of a pickup electrode according to the invention.

FIG. 8 illustrates another method for determining the location of a pickup electrode according to the invention.

In FIG. 8, the y-axis shows distance of a simulated test ion of mass/charge ratio m from the reference axis 208 ("radius") in mm, as a function of time of flight of that test ion (TOF) in us. Also shown on FIG. 8 is the radius $r_0$ of the pick-up electrode E5A, which can be varied in the simulation, and t1 and t2, which is the time taken for the test ion to travel from the reflection point to the time at which it passes the pick-up electrode E5A for the first time (t1) and the time at which it passes the pick-up electrode E5A for the second time (t2).

In FIG. 8 one possible E5A electrodes shape and positions are shown for the sake of illustration.

In order to obtain suppression of harmonic H2 in the frequency spectrum, the radius $r_0$ of the pick-up electrode E5A is varied until $t_{sep}(m)=t_1-t_2$ meet the required value of $$\Delta t_{sep}(m) = \frac{3}{4 \cdot f_{sig}(m)}.$$

For example, for H2, H6, H10, . . . suppression (n=2) one should seek for times of flight equal to (where p=0)

$$t_1 = \frac{1}{2}T_{sig} - \frac{1}{2}T_{sep} = \frac{1}{2}\left(\frac{1}{f_{sig}} - \frac{1}{2f_2}\right) = \frac{3}{8f_{sig}}$$

-continued $$t_2 = \frac{1}{2}T_{sig} + \frac{1}{2}T_{sep} = \frac{1}{2}\left(\frac{1}{f_{sig}} + \frac{1}{2f_2}\right) = \frac{5}{8f_{sig}}$$

according to FIG. 8. Time of flight is with respect to the time when ion reach the reflection point.

Theoretical Explanation

We now provide a theoretical explanation which may be useful for understanding the present invention.

Figure 9A:
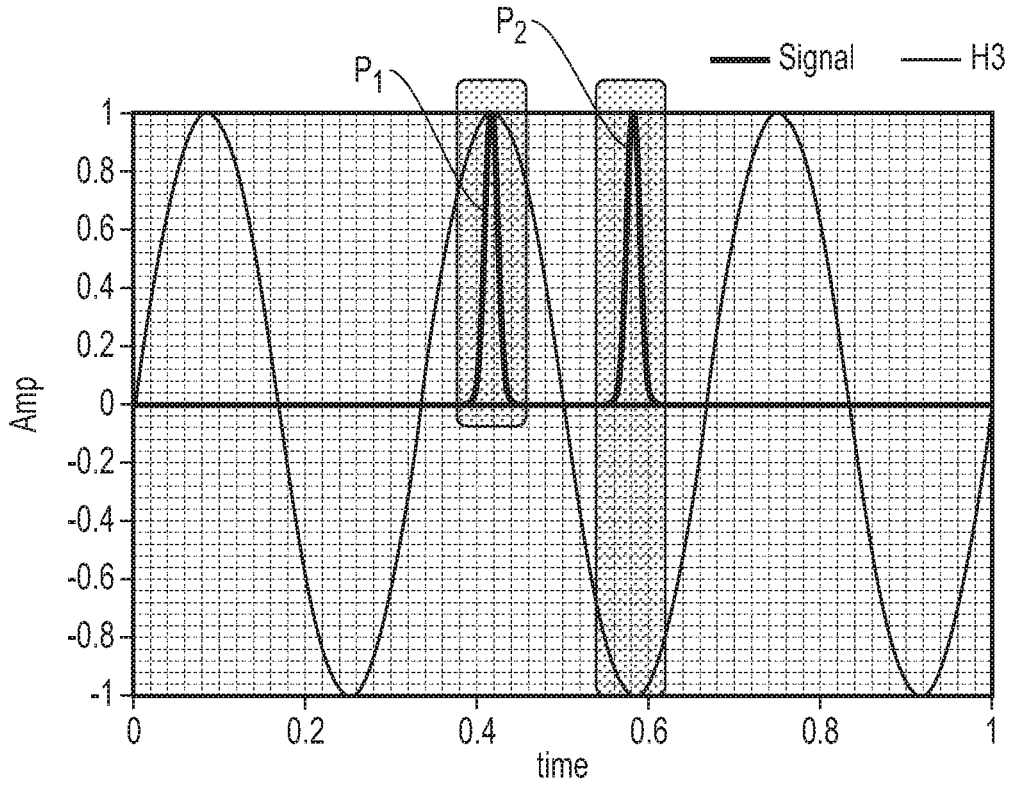
FIGS. 9A-9B, FIGS. 10A(i)-10A(iii), FIGS. 10B(i)-10B (iii)
Figure 9B:
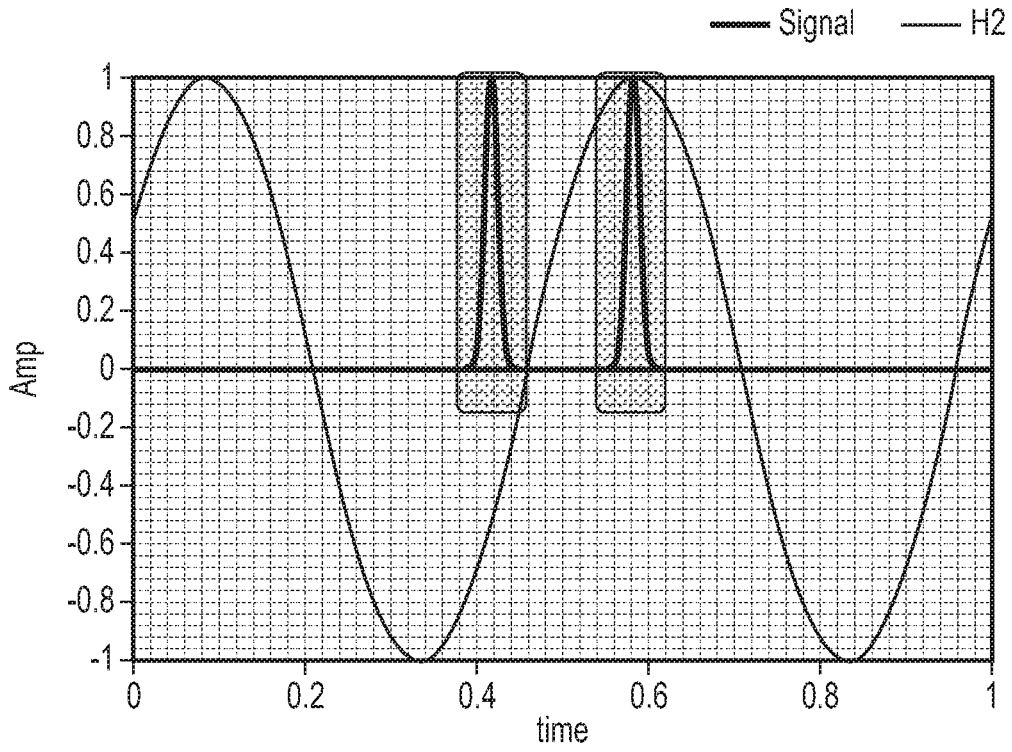

As illustrated by FIGS. 9A and 9B, a core idea underlying this invention is to locate electrodes so that signal pulses (the peaks in FIGS. 9A and 9B labeled $P_1$ and $P_2$) fall into the maxima and minima of sinusoidal curves (Fourier harmonics).

Since the Fourier coefficient $C_n$ is calculated as $C_n=\int S(t)e^{-2\pi int}dt$ where S(t) is the signal and $C_n$ is zero when time separation between signal pulses is equal to $T_{sig}(m)/2$ or, in the general case, $$\frac{1}{2 \cdot n \cdot f_{sig}(m)}.$$

Thus, where $$\Delta t_{sep}(m) = \frac{1}{2 \cdot n \cdot f_{sig}(m)}:$$

$C_n=\int S(t)e^{-2\pi int}dt=I_1+I_2=0$, where $I_1$ and $I_2$ are integrals taken in the vicinity of the $P_1$ and $P_2$ peaks, respectively.

FIG. 9A shows the time domain signal and the Fourier harmonic signal for the third harmonic (H3), where the time separation $\Delta t_{sep}(m)$ is configured to suppress the third harmonic (n=3). As shown here, the time domain signal pulses $P_1$ and $P_2$ line up with the maxima and minima of the H3 Fourier harmonic, and therefore the Fourier coefficient $C_3$ is zero ($C_3=I_1+I_2=0$). This would also be true of the $H_{(2k+1)n}$, where k=0, 1, 2, 3 harmonics, i.e. the H9, H15 harmonics etc.

FIG. 9B shows the time domain signal and the Fourier harmonic signal for the second harmonic (H2), where the time separation $\Delta t_{sep}(m)$ is configured to suppress the third harmonic (n=3). As shown here, the time domain signal pulses $P_1$ and $P_2$ do not line up with the maxima and minima of the H2 Fourier harmonic, and therefore the Fourier coefficient $C_2$ is not zero ($C_2=I_1+I_2\neq 0$). This would also be true of all other harmonics apart from the $H_{(2k+1)n}$ harmonics, i.e. the H1, H4, H5 harmonics etc.

A skilled person would understand that the time domain signal pulses do not have to fall in adjacent peaks/troughs in the Fourier harmonic signal in order for the Fourier coefficient to be zero. This is illustrated by FIGS. 10A and 10B, which illustrate that the general case for cancellation of the Fourier coefficient $C_n$ is met where $$\Delta t_{sep}(m) = \frac{2p+1}{2 \cdot n \cdot f_{sig}(m)},$$

where p is an integer that is 0 or more (0 is considered an integer for these purposes).

Figure 10A:
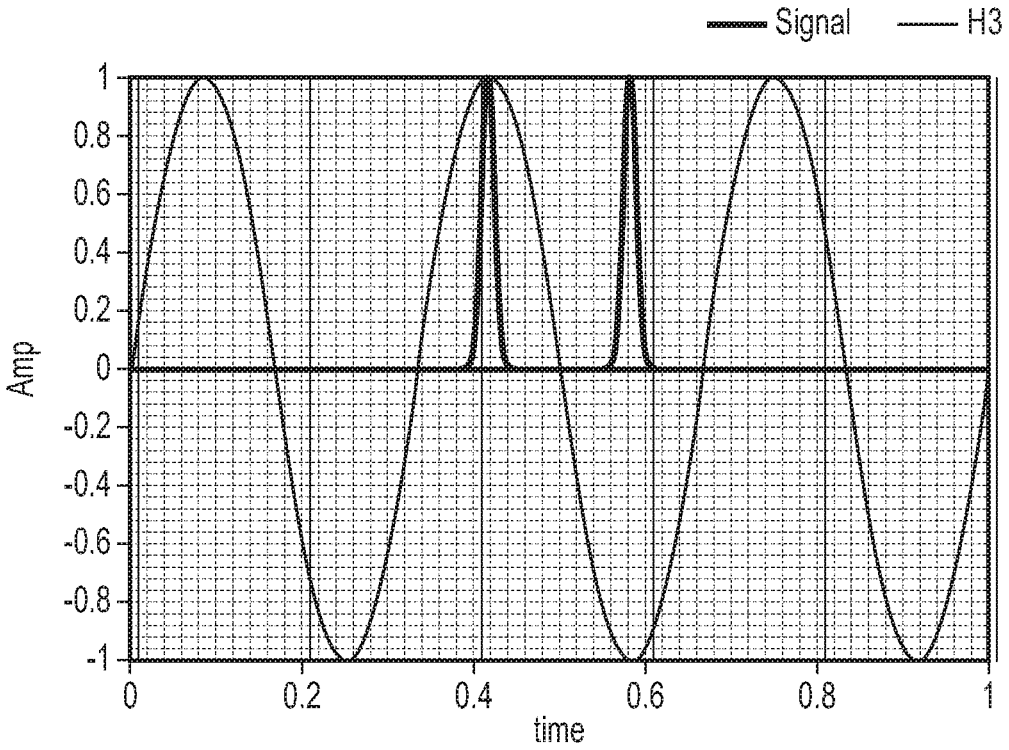
Figure 10B:
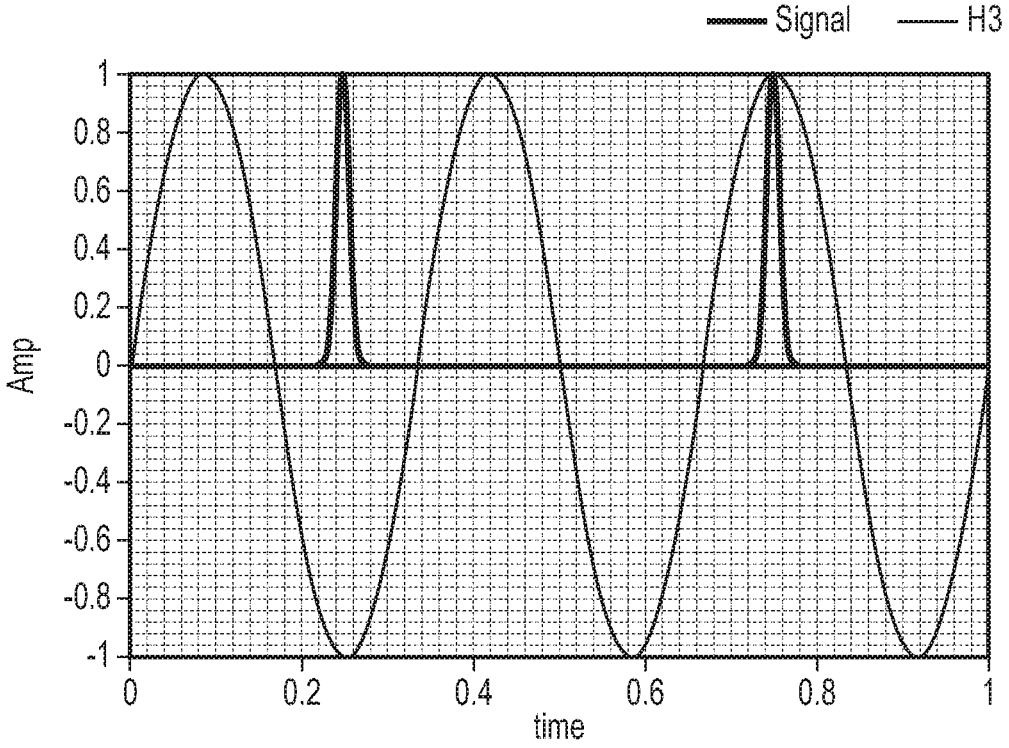

FIGS. 10A(i)-(iii) show H3, H9 and H15 Fourier harmonic signals and time domain pulses located at $$\Delta t_{sep}(m) = \frac{1}{6 \cdot f_{sig}(m)}$$

(whee n=3 and p=1) so as H3, H9 and H15 harmonics in the corresponded frequency spectrum will be suppressed (note that here, the signal peaks fall into maxima and minima of each of these Fourier harmonic signals).

FIGS. 10B(i)-(iii) show H3, H9 and H15 Fourier harmonic signals and time domain pulses located at $$\Delta t_{sep}(m) = \frac{3}{6 \cdot f_{sig}(m)}$$

(where n=3 and p=1) so as H3, H9 and H15 harmonics in the corresponded frequency spectrum will be suppressed (note that here, again the signal peaks fall into maxima and minima of each of these Fourier harmonic signals).

Figure 11A:
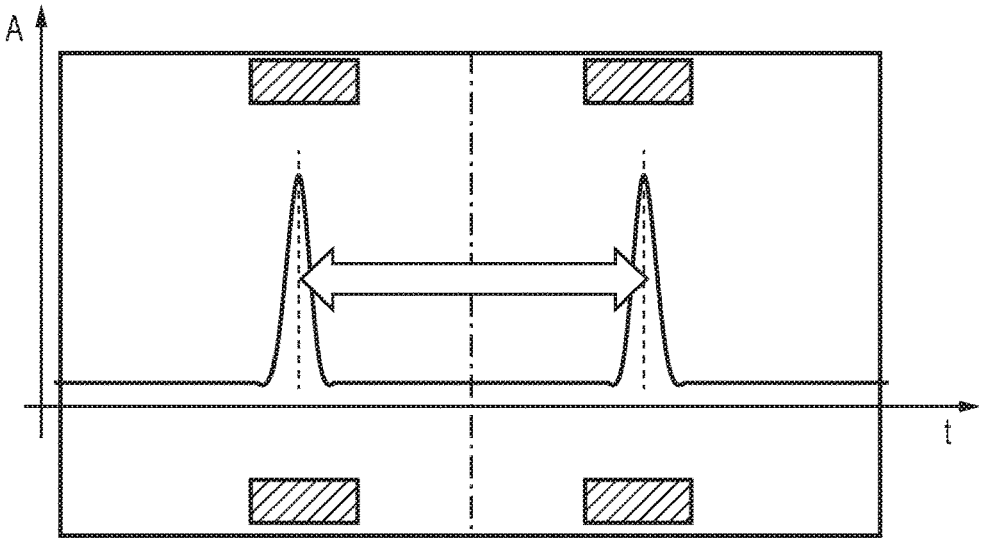
FIG. 11A-11C are provided to assist with a theoretical explanation provided below.
Figure 11B:
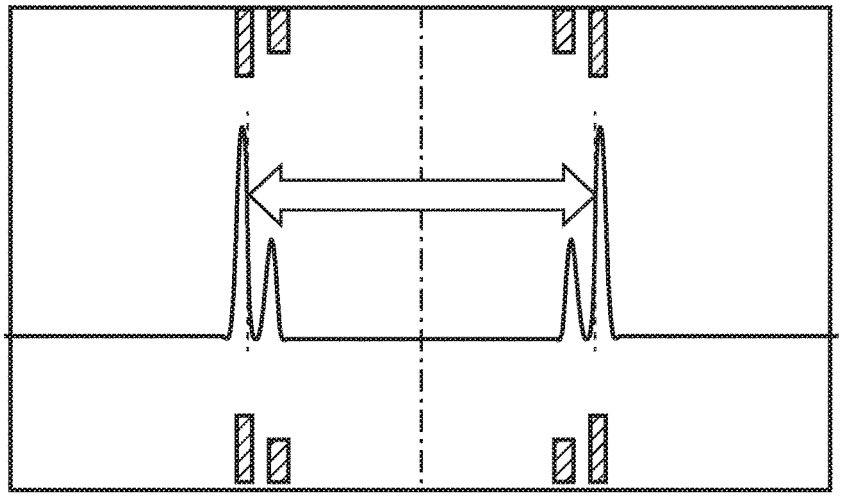
Figure 11C:
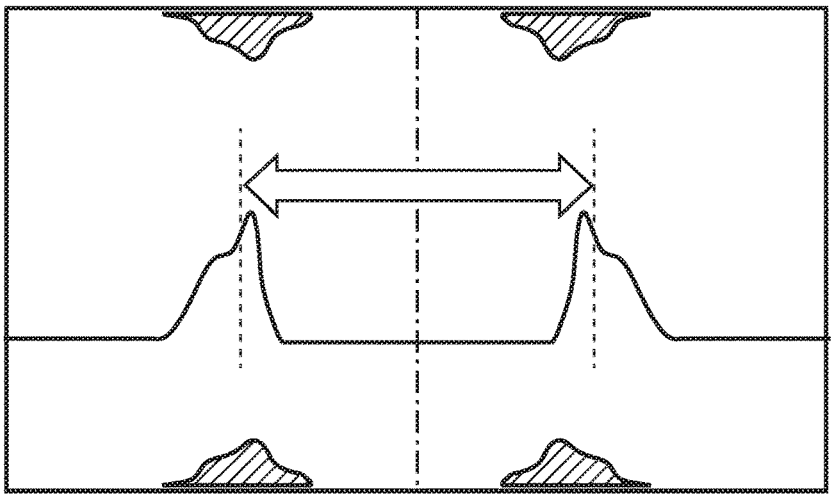

FIGS. 11A-C show how the time separation $\Delta t_{sep}(m)$ may be measured with respect to corresponding features in the two signal pulses caused by ions having the given mass/charge ratio m within each signal period $T_{sig}(m)$. Two-sided arrow represents separation time between dotted lines which is to be adjusted according to $$\Delta t_{sep}(m) = \frac{2p+1}{2 \cdot n \cdot f_{sig}(m)}$$

formula. Shaded cross-sections of pick-up electrodes which produce respective signal pulses are put just for the sake of clarity.

In FIG. 11A, the pick-up electrodes are positioned at coordinates corresponded to times when the signal pulses occur. In this example, each signal pulse is a single peak. In this example, the time separation $\Delta t_{sep}(m)$ between signal pulses may be measured with respect to the maxima of each signal pulse, i.e. the maxima of the two peaks.

In FIG. 11B, each signal pulse has a more complex form, which in this case is a double peak. The signal pulses are the mirror image of each other. In this example, the time separation $\Delta t_{sep}(m)$ between signal pulses may be measured with respect to the weighted centre of each signal pulse, i.e. the weighted centre of each double peak (dotted line).

In FIG. 11C, each signal pulse has a more complex form, which in this case is a continuous function of time A=A(t). The signal pulses are the mirror image of each other. In this example, the time separation $\Delta t_{sep}(m)$ between signal pulses may be measured with respect to the weighted centre of each signal pulse, i.e. the weighted centre of each continuous function (dotted line).

Weighted centre is to be defined as following. In a discrete case when each pulse is a set of similar shape peaks the centre position is $$\langle t \rangle = \frac{\sum_{i=1}^{n} A_i t_i}{\sum_{i=1}^{n} A_i},$$

where $A_i$—maximum of each peak in the pulse, $t_i$—time position of the respective maximum. Pulses must be mirrored with respect to the reference axis.

In non-discrete case $$\langle t \rangle = \frac{\int \rho(t) t dt}{\int \rho(t) dt}$$

where $$\rho(t) = \frac{dA(t)}{dt},$$

A(t) is time domain pulse function and integration is carried out in the vicinity of the pulse. Pulses must be mirrored with respect to the reference axis.

Note: the form of pick-up electrode being used here is not particularly important, just it's position.

Symmetry Arrangements

As noted above, in general terms, the pick-up electrode(s) is(are) preferably arranged such that the two signal pulses within each signal period $T_{sig}(m)$ are substantially the mirror image of each other in the time domain.

Figure 12A:
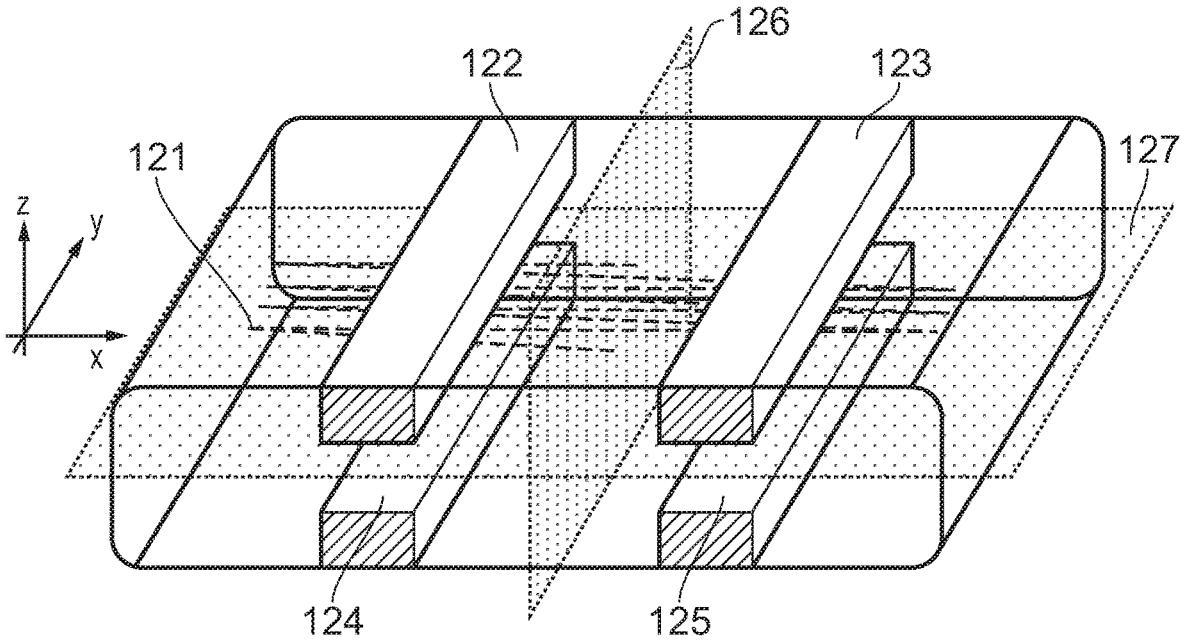
FIGS. 12A-12C, FIGS. 13A-13C, FIGS. 14A-14C and FIG. 15 are provided to illustrate various symmetry arrangements.
Figure 12B:
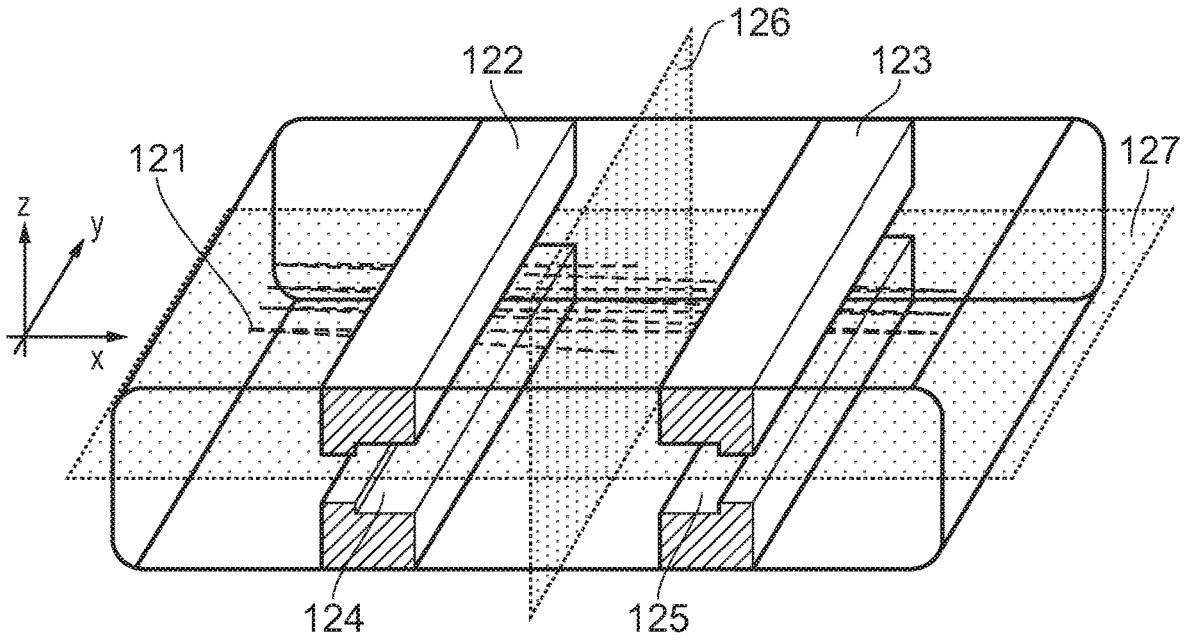
Figure 12C:
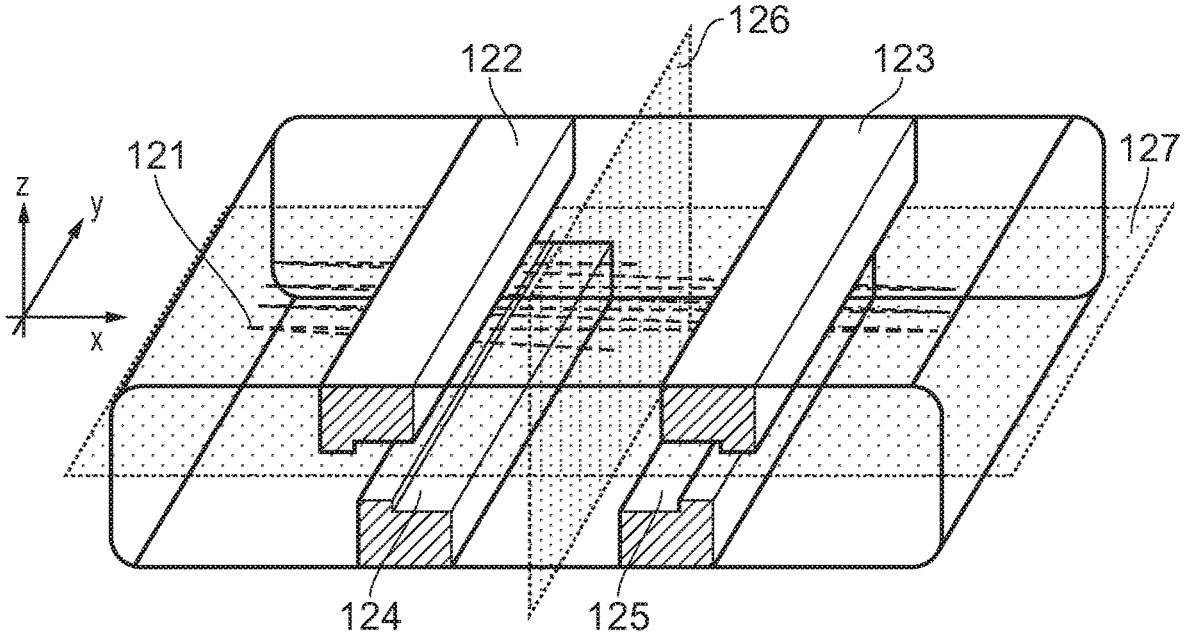

FIGS. 12A-C, 13A-C, 14A-C, and 15 illustrate electrodes arranged to produce mirror image pulses within one period of oscillations and either arranged to produce symmetric shape pulses in the time domain or arranged not to produce symmetric shape pulses in the time domain for various ion trap geometries. In detail:

FIGS. 12A-C show a linear ion trap geometry (multi-reflectron mirror type) in which ions trajectory 121 is isochronous along ion motion direction and drifts in a direction perpendicular this direction, where:

- FIG. 12A shows electrodes arranged to produce symmetric shape image peaks with mirror image pulses because pickup electrodes cross-sections 122-123 and 124-125 are of symmetric shapes and electrodes are positioned symmetrically with respect to symmetry planes 126 and 127. Pick-up electrodes are mirrored with respect to symmetry plane 127 which is preferable to sustain isochronous motion of ions.
- FIG. 12B shows electrodes not arranged to produce symmetric shape peaks but to produce mirror image pulses because puck-up electrodes cross-sections 122-123 and 124-125 are not of symmetric shapes and electrodes are positioned symmetrically with respect to symmetry planes 126 and 127. Pick-up electrodes are mirrored with respect to symmetry plane 127 which is preferable to sustain isochronous motion of ions.
- FIG. 12C shows electrodes not arranged to produce symmetric shape peaks but to produce mirror image pulses because puck-up electrodes cross-sections 122-123 and 124-125 are not of symmetric shapes and electrodes are positioned symmetrically with respect to symmetry planes 126 and 127. Pick-up electrodes are not mirrored with respect to symmetry plane 127 which is not preferable as isochronous motion of ions may be difficult to sustain. Note that the symmetry as shown in FIGS. 12A-B is more preferable as it keeps z symmetry as well.

Figure 13A:
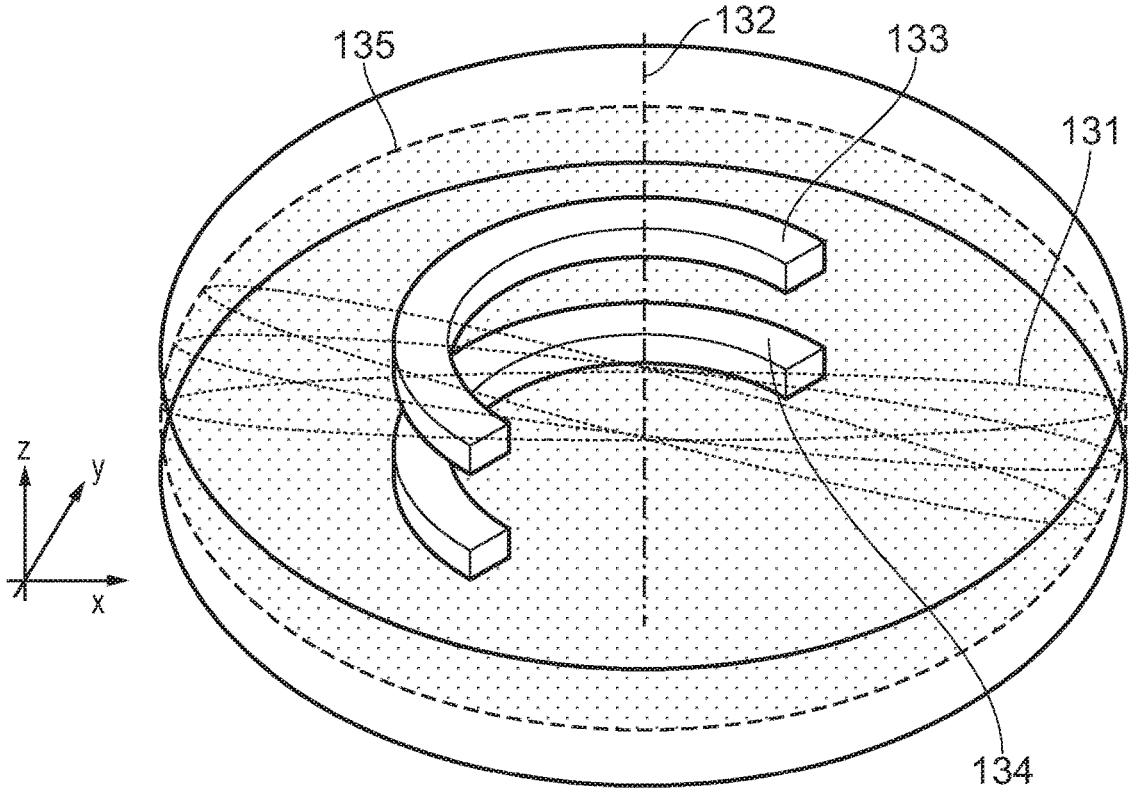
Figure 13B:
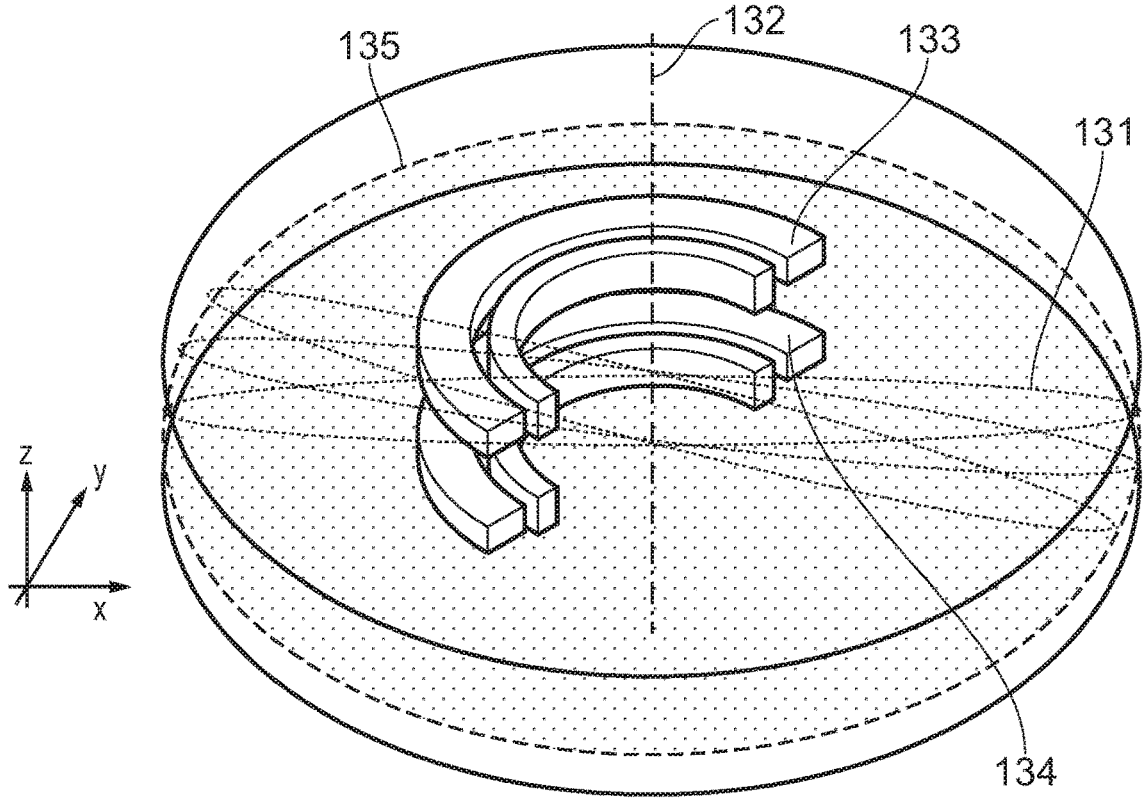
Figure 13C:
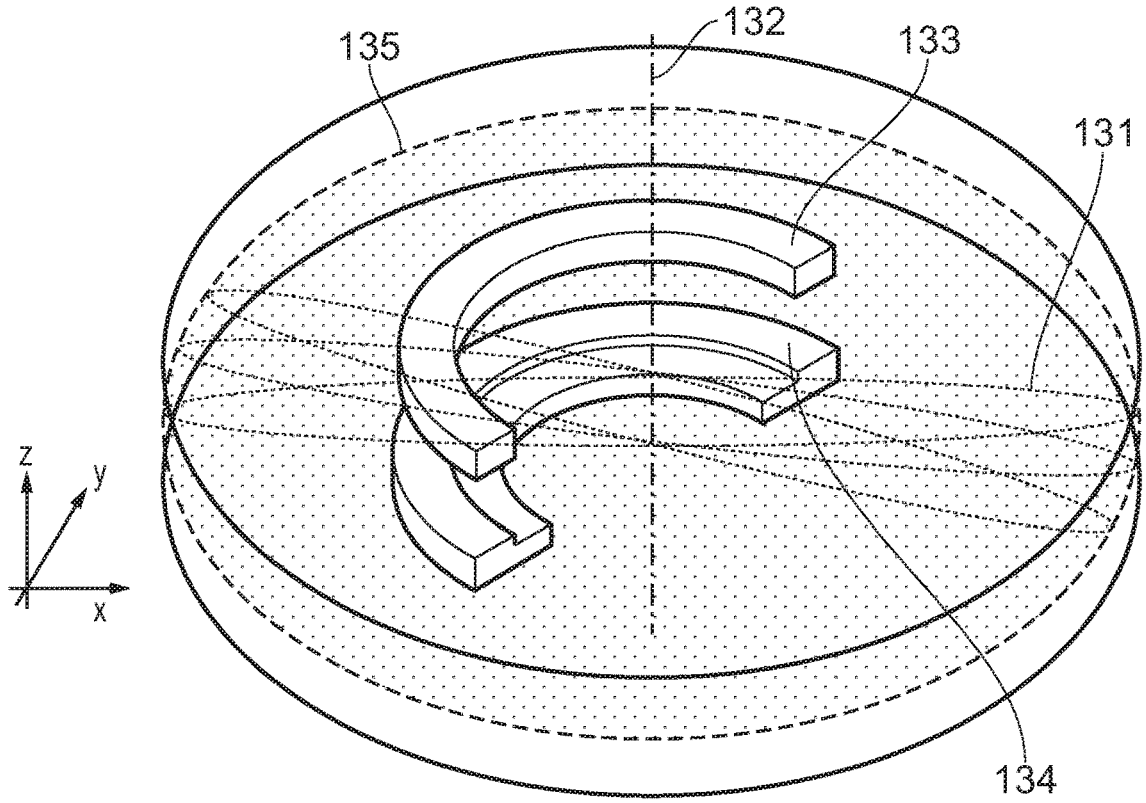

FIGS. 13A-C show a cylindrical ion trap geometry (multireflectron mirror type) in which ions trajectory 131 is isochronous along ions motion direction and drifts around the symmetry axis 132, where:

FIG. 13A shows electrodes arranged to produce symmetric shape peaks with mirror image pulses because electrodes 133 and 134 cross-sections are of symmetric shape and the electrodes axes coincide with the trap axis symmetry 132. Pick-up electrodes are mirrored with respect to symmetry plane 135 which is preferable to sustain isochronous motion of ions. *

FIG. 13B shows electrodes not arranged to produce symmetric shape peaks but to produce mirror image pulses because electrodes 133 and 134 cross-sections are not of symmetric shape and the electrodes axes coincide with the trap axis symmetry 132. Pick-up electrodes are mirrored with respect to symmetry plane 135 which is preferable to sustain isochronous motion of ions.

FIG. 13C shows electrodes not arranged to produce symmetric shape peaks but to produce mirror image pulses because puck-up electrode 134 cross-section is not of symmetric shape and the electrodes axes coincide with the trap axis symmetry 132. Pick-up electrodes are not mirrored with respect to symmetry plane 135 which is not preferable as isochronous motion of ions may be difficult to sustain. Note that the symmetry as shown in FIGS. 13A-B is more preferable as it keeps z symmetry as well.

Figure 14A:
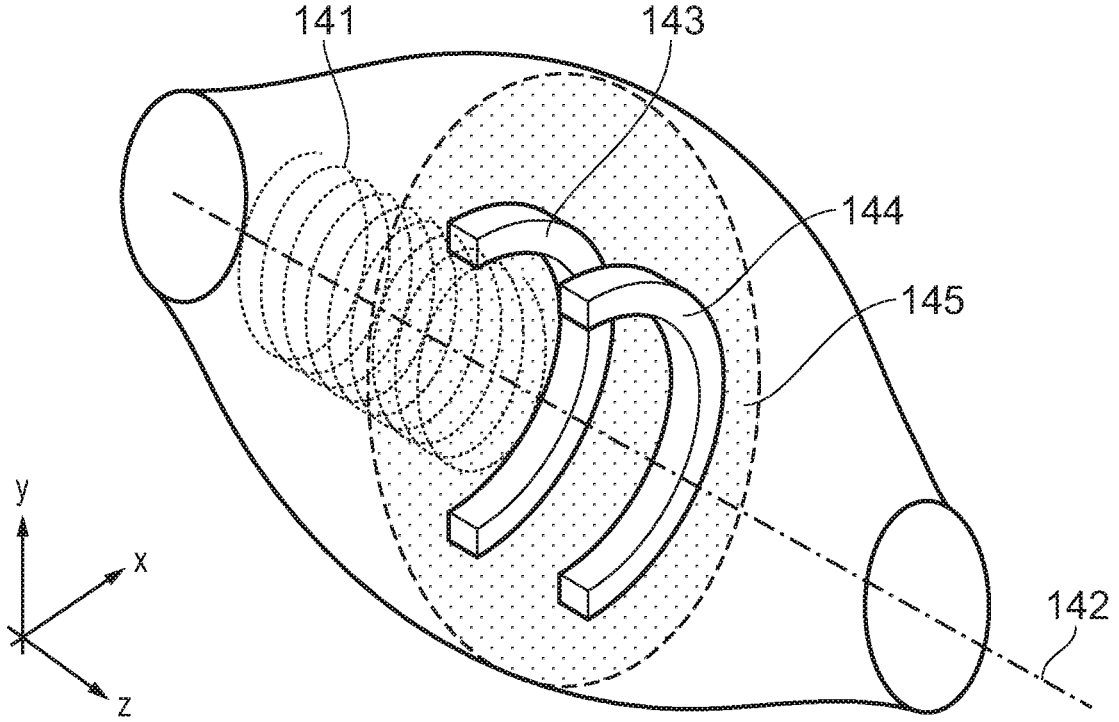
Figure 14B:
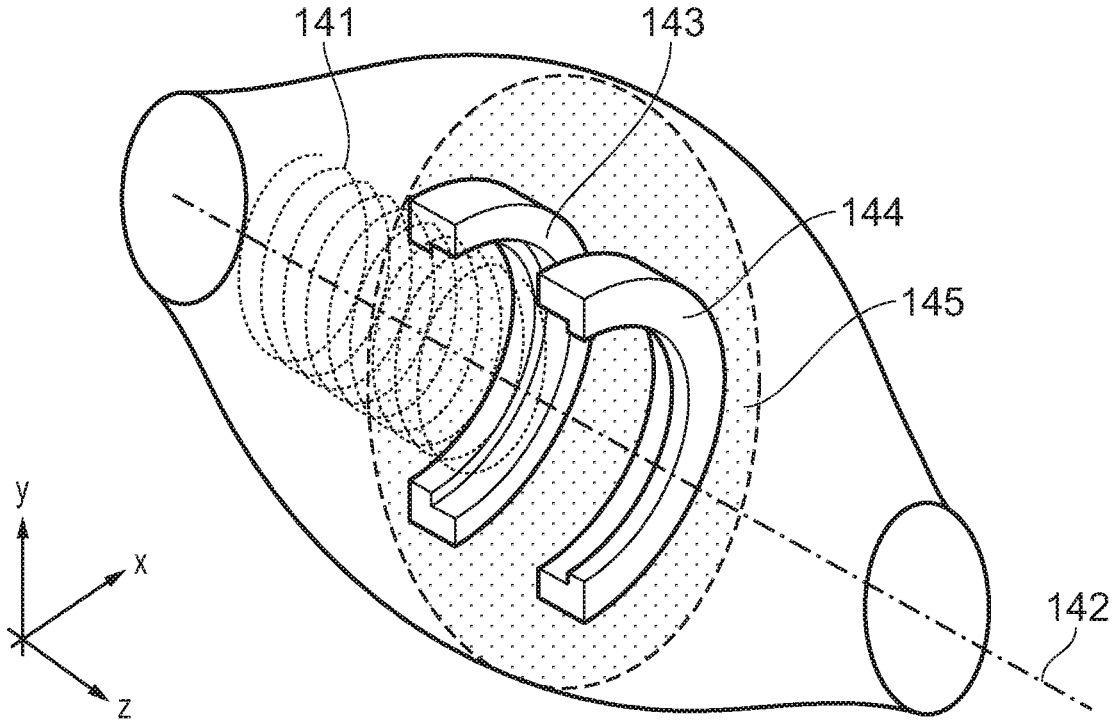
Figure 14C:
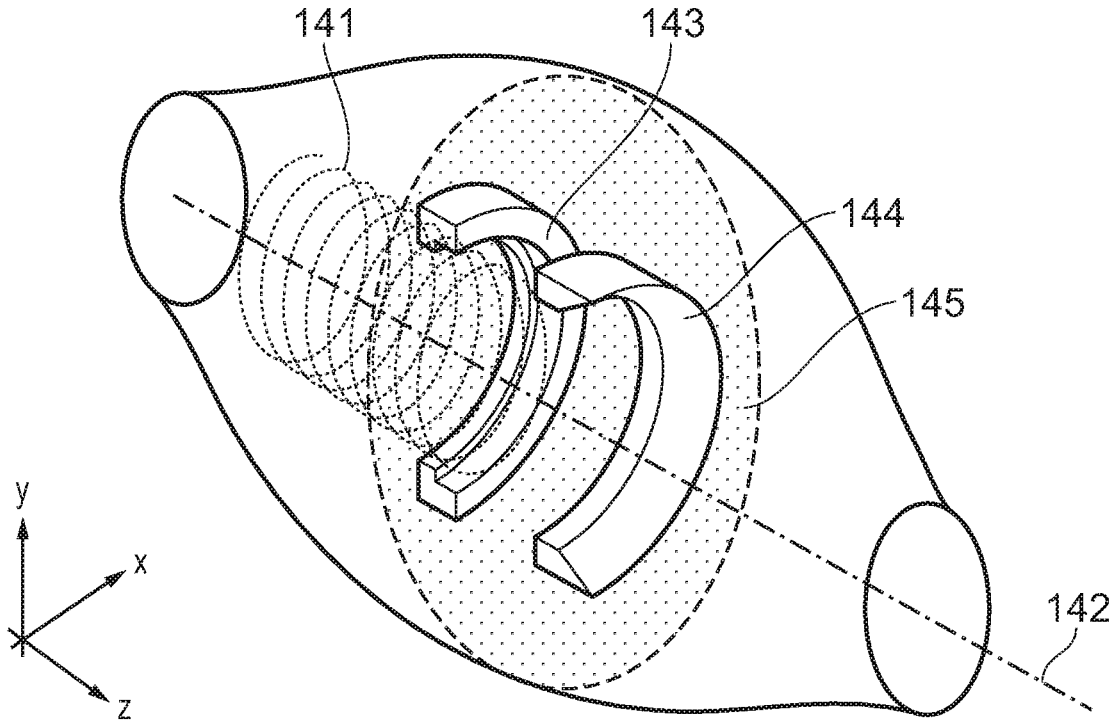

FIGS. 14A-C show cylindrical ion trap geometry (Orbitrap-like type) in which ions trajectory 141 revolves around symmetry axis 142 and undergo isochronous motion along this axis, where:

FIG. 14A shows electrodes arranged to produce symmetric shape peaks with mirror image pulses because electrodes 143 and 144 cross-sections are of symmetric shape and the electrodes axes coincide with the trap axis symmetry 142. Pickup electrodes are mirrored with respect to symmetry plane 145 which is preferable to sustain isochronous motion of ions.

FIG. 14B shows electrodes not arranged to produce symmetric shape peaks but to produce mirror image pulses because electrodes 143 and 144 cross-sections are not of symmetric shape and the electrodes axes coincide with the trap axis symmetry 142. Pick-up electrodes are mirrored with respect to symmetry plane 145 which is preferable to sustain isochronous motion of ions. *

FIG. 14C shows electrodes not arranged to produce symmetric shape peaks but to produce mirror image pulses because electrodes 143 and 144 cross-sections are not of symmetric shape and the electrodes axes coincide with the trap axis symmetry 142. Pick-up electrodes are not mirrored with respect to symmetry plane 145 which is not preferable as isochronous motion of ions may be difficult to sustain.

Figure 15:
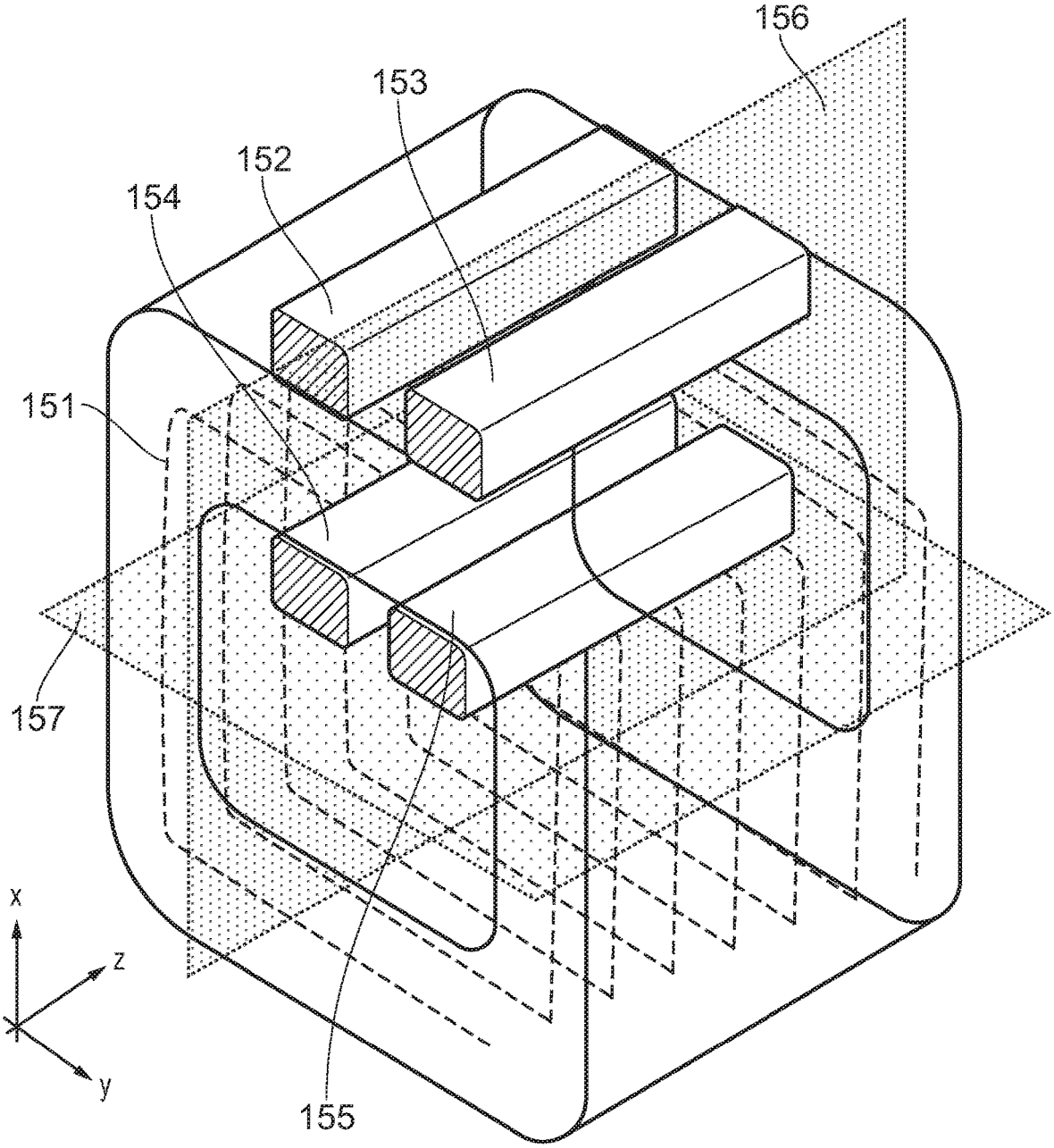

FIG. 15 shows a multi-turn TOF-like ion trap geometry in which ions trajectory is isochronous along ion motion direction 151 with drift in a direction perpendicular to this direction, where:

FIG. 15 shows electrodes arranged to produce symmetric shape image peaks with mirror image pulses because puck-up electrodes cross-sections 152-153 and 154-155 are of symmetric shapes and electrodes are positioned symmetrically with respect to symmetry plane 156. Pick-up electrodes are mirrored with respect ion motion direction 151 which is preferable to sustain isochronous motion of ions. Similar to previous geometries, electrode shapes may be not mirrored with respect to ion motion direction 151 but should be symmetric with respect to symmetry plane 157 or other symmetry plane if it exists.

Final Statements

The features disclosed in the foregoing description, or in the following claims, or in the accompanying drawings, expressed in their specific forms or in terms of a means for performing the disclosed function, or a method or process for obtaining the disclosed results, as appropriate, may, separately, or in any combination of such features, be utilized for realizing the invention in diverse forms thereof.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the spirit and scope of the invention.

For the avoidance of any doubt, any theoretical explanations provided herein are provided for the purposes of improving the understanding of a reader. The inventors do not wish to be bound by any of these theoretical explanations.

Any section headings used herein are for organizational purposes only and are not to be construed as limiting the subject matter described.

Throughout this specification, including the claims which follow, unless the context requires otherwise, the word "comprise" and "include", and variations such as "comprises", "comprising", and "including" will be understood to imply the inclusion of a stated integer or step or group of integers or steps but not the exclusion of any other integer or step or group of integers or steps.

It must be noted that, as used in the specification and the appended claims, the singular forms "a," "an," and "the" include plural referents unless the context clearly dictates otherwise. Ranges may be expressed herein as from "about" one particular value, and/or to "about" another particular value. When such a range is expressed, another embodiment includes from the one particular value and/or to the other particular value. Similarly, when values are expressed as approximations, by the use of the antecedent "about," it will be understood that the particular value forms another embodiment. The term "about" in relation to a numerical value is optional and means for example+/−10%.

REFERENCES

A number of publications are cited above in order to more fully describe and disclose the invention and the state of the art to which the invention pertains. Full citations for these references are provided below. The entirety of each of these references is incorporated herein.

WO2012/116765A1
EP2642508A2
EP2779206A2
WO2017162779A1

The invention claimed is:

1. An apparatus configured to produce an image charge/current signal representative of trapped ions undergoing oscillatory motion, the apparatus including:

an electrostatic ion trap configured to trap ions such that the trapped ions undergo oscillatory motion in the electrostatic ion trap;

an image charge/current detector configured to obtain an image charge/current signal representative of trapped ions undergoing oscillatory motion in the electrostatic ion trap, wherein the electrostatic ion trap configured to trap ions such that the image charge/current signal in the time domain repeats, for ions of a given mass/charge ratio m, at a frequency $f_{sig}(m)$ [Hz] with a signal period $T_{sig}(m)$ [s];

wherein the image charge/current detector includes one or more pickup electrodes configured to obtain the image charge/current signal;

wherein the one or more pickup electrodes are arranged to detect two signal pulses caused by ions having the given mass/charge ratio m within each signal period $T_{sig}(m)$; and wherein the one or more pickup electrodes are further arranged such that the time separation $\Delta t_{sep}(m)$ between the two signal pulses caused by ions having the given mass/charge ratio m within each signal period $T_{sig}(m)$ is approximately equal to $$\frac{2p+1}{2 \cdot n \cdot f_{sig}(m)}$$

preferably so as to suppress a predetermined nth harmonic within the image charge/current signal, where n is an integer that is 1 or more, and where p is an integer that is 0 or more.

2. An apparatus according to claim 1, wherein the apparatus is configured to produce an image charge/current signal representative of trapped ions undergoing non-harmonic oscillatory motion.

3. An apparatus according to claim 1, wherein n is less than 5.

4. An apparatus according to claim 1, wherein n=2 or n=3.

5. An apparatus according to claim 4, wherein n=2 and the apparatus is configured to be used with ions having a mass/charge ratio range $m_{min}$ to $m_{max}$ such that the H1 peaks in the frequency spectrum for ions in the mass/charge ratio range do not overlap with the H3 peaks in the frequency spectrum for ions in the mass/charge ratio range.

6. An apparatus according to claim 4, wherein n=3 and the apparatus is configured to be used with ions having a mass/charge ratio range ($m_{min}$ to $m_{max}$) such that the H2 peaks in the frequency spectrum for ions in the mass/charge ratio range do not overlap with the H4 peaks in the frequency spectrum for ions in the mass/charge ratio range.

7. An apparatus according to claim 1, wherein the one or more pickup electrodes are arranged such that the two signal pulses within each signal period $T_{sig}(m)$ are substantially the mirror image of each other in the time domain.

8. An apparatus according to claim 1, wherein the apparatus is an electrostatic ion trap.

9. An apparatus according to claim 8, wherein the/each pickup electrode is embedded within a respective field forming electrode of the electrostatic ion trap.

10. An apparatus according to claim 9, wherein the/each pickup electrode embedded within a respective field forming electrode of the electrostatic ion trap is configured to be moveable within the respective field forming electrode in which it is embedded.

11. An apparatus according to claim 8, wherein the electrostatic ion trap has a first set of concentrically arranged circular field forming electrodes centered on a reference axis and arranged on a first side of a mid-plane, and a second set of concentrically arranged circular field forming electrodes centered on the reference axis and arranged on a second side of the mid-plane, wherein the field forming electrodes are configured to generate an electrostatic field in which ions undergo linear oscillatory motion in the mid-plane, whilst precessing around the reference axis.

12. An apparatus according to claim 11, wherein the one or more pickup electrodes include:

a first circular pickup electrode that is centered on the reference axis, wherein the first circular pickup electrode is positioned on the first side of the mid plane, among the first set of field forming plate electrodes.

13. An apparatus according to claim 12, wherein the first pickup electrode is embedded within one of the first set of field forming plate electrodes.

14. An apparatus according to claim 12, wherein the one or more pickup electrodes include: a second pickup electrode that is centered on the reference axis, wherein the second pickup electrode is positioned on the second side of the mid plane, among the second set of field forming plate electrodes, wherein the second pickup electrode is optionally embedded within one of the second set of field forming plate electrodes.

15. A method of tuning an apparatus according to claim 1, wherein the method includes:

increasing the suppression of the predetermined nth harmonic relative to the fundamental (H1) harmonic in a frequency spectrum obtained from the image/charge current signal for ions of a given mass/charge ratio m by changing the position of the/each pick-up electrode; and/or increasing the suppression of the predetermined nth harmonic relative to the fundamental (H1) harmonic in a frequency spectrum obtained from the image/charge current signal for ions of a given mass/charge ratio m by changing the shape of the/each pick-up electrode.

* * * * *